United States Patent [19]

Inoue et al.

[11] Patent Number: 4,966,836

[45] **Date of Patent: * Oct. 30, 1990**

[54] DIRECT POSITIVE PHOTOGRAPHIC LIGHT-SENSITIVE MATERIAL

[75] Inventors: Noriyuki Inoue; Shigeo Hirano; Tetsuo Kojima; Mitsuru Yamamoto, all of Kanagawa, Japan

[73] Assignee: Fuji Photo Film Co., Ltd., Kanagawa, Japan

[ * ] Notice: The portion of the term of this patent subsequent to Aug. 22, 2006 has been disclaimed.

[21] Appl. No.: 278,919

[22] Filed: Dec. 2, 1988

[30] Foreign Application Priority Data

Dec. 2, 1987 [JP] Japan ..... 62-304995

[51] Int. Cl.[5] ..... G03C 1/485

[52] U.S. Cl. ..... 430/598

[58] Field of Search ..... 430/598, 264

[56] References Cited

U.S. PATENT DOCUMENTS 4,115,122 9/1978 Adachi et al. .
4,481,285 11/1984 Takagi et al. .

FOREIGN PATENT DOCUMENTS 0249239 12/1987 European Pat. Off. .
0276842 8/1988 European Pat. Off. .
2655870 6/1977 Fed. Rep. of Germany .
1150553 4/1969 United Kingdom .

OTHER PUBLICATIONS

Patent Abstracts of Japan, vol. 10, No. 15 (P-422) [2072] 1/21/86, for JP-A-60170843 (Konishiroku Shashin Kogyo K.K.) 9/4/85.

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A direct positive photographic light-sensitive material comprising a support having thereon at least one internal latent image type silver halide emulsion layer not having been previously fogged, wherein the photographic light-sensitive material contains at least one nucleating agent represented by a specific formula and at least one nucleating accelerating agent selected from compounds represented by two specific formulae. The direct positive photographic light-sensitive material according to the present invention provides direct positive images having a high maximum image density and a low minimum image density, and is less susceptible to change in photographic properties such as reduction in the maximum image density and increase in the minimum image density when it is preserved under high temperature and/or high humidity conditions.

19 Claims, No Drawings

DIRECT POSITIVE PHOTOGRAPHIC LIGHT-SENSITIVE MATERIAL

FIELD OF THE INVENTION

The present invention relates to a photographic light-sensitive material, and more particularly to a direct positive photographic light-sensitive material It is well known that an internal latent image type silver halide emulsion not having been previously fogged is imagewise exposed to light and then subjected to surface development either after fogging treatment or during fogging treatment to obtain a direct positive image. The internal latent image type silver halide photographic emulsion used herein is an emulsion in which silver halide grains have sensitivity specs predominantly in the interior thereof and form a latent image predominantly in the interior upon exposure to light.

Various techniques are known in this field of technology, such as those described, for example, in U.S. Pat. Nos. 2,592,250, 2,466,957, 2,497,875, 2,588,982, 3,317,322, 3,761,266, 3,761,276, and 3,796,577, British Patents Nos. 1,151,363, 1,150,553, and 1,011,062. According to these conventional techniques, photographic light-sensitive materials providing a direct positive image with relatively high sensitivity can be produced.

For the details of the direct positive image formation mechanism, reference can be made to it, for example, in T. H. James, *The Theory of the Photographic Process,* 4th. Ed., Ch. 7, pp. 182 to 193 and U.S. Pat. No. 3,761,276.

It is believed that a direct positive image is formed through the following mechanism: First, imagewise exposure results in the formation of an internal latent image in the interior of silver halide grains, which leads to the formation of fog centers selectively on the surface of the unexposed silver halide grains by surface desensitization based on the internal latent image, and subsequent conventional surface development processing results in formation of a photographic image (a direct positive image) on the unexposed area.

Selective formation of fog centers described above can be generally effected by a "light fogging method" in which the entire surface of a light-sensitive layer is secondarily exposed to light as described, for example, in British Patent No. 1,151,363 or by a "chemical fogging method" using a nucleating agent described, for example, in *Research Disclosure,* Vol. 151, No. 15162 (November, 1976), pp. 76 to 78.

In the formation of a direct positive color image, the internal latent image type silver halide light-sensitive material is subjected to surface color development processing either after or simultaneously with fogging treatment and then subjected to bleaching and fixing (or bleach-fixing). After the bleaching and fixing processing, the photographic material is usually washed with water and/or subjected to stabilizing processing.

Hydrazine compounds are well known as nucleating agents which are employed in the above-described "chemical fogging method". In general, hydrazine type nucleating agents are excellent in view of discrimination since they provide a large difference between maximum density (Dmax) and minimum density (Dmin). However, they are disadvantageous because they require processing at a high pH (pH > 12).

As nucleating agents which function in processing at a low pH (pH ≦ 12), heterocyclic quaternary ammonium salts are known and described, for example, in U.S. Pat. Nos. 3,615,615, 3,719,494, 3,734,738, 3,759,901, 3,854,956, 4,094,683 and 4,306,016, British Patent No. 1,283,835, JP-A-52-3426, and JP-A-52-69613 (the term "JP-A" as used herein means an "unexamined published Japanese patent application"). Particularly, propargyl- or butynyl-substituted heterocyclic quaternary ammonium salt compounds as described in U.S. Pat. No. 4,115,122 are excellent nucleating agents in view of discrimination when used in direct positive silver halide emulsions. However, in silver halide emulsions, sensitizing dyes are employed for the purpose of spectral sensitization. In such cases, competitive adsorption of the sensitizing dyes and the heterocyclic quaternary ammonium type nucleating agents onto silver halide grains takes place, and thus, it is necessary to add a large amount of the quaternary ammonium salt type nucleating agents which are of low adsorptivity. In particular, in the case of multilayer color photographic light-sensitive materials, unevenness of density and destruction of color balance may undesirably occur. Therefore, these compounds are still insufficient. Further, these tendencies become more remarkable upon preservation of the photographic material under high temperature and high humidity conditions.

In order to resolve the above described problems, quaternary salt type nucleating agents having an AgX adsorption accelerating thioamido group are disclosed in U.S. Pat. No. 4,471,044. Although the amount to be added necessary to obtain a sufficiently high Dmax is reduced and the decrease in Dmax during preservation at high temperature is controlled by introduction of the adsorptive group, these effects still do not achieve a fully satisfactory level.

SUMMARY OF THE INVENTION

It is, therefore, an object of the present invention to provide a direct positive photographic light-sensitive material which provides a high maximum image density and a low minimum image density.

Another object of the present invention is to provide a direct positive photographic light-sensitive material which undergoes less change in photographic properties such as a decrease in the maximum image density and an increase in the minimum image density during preservation under high temperature and/or high humidity conditions.

Other objects of the present invention will become apparent from the following description and examples.

These objects of the present invention are accomplished with a direct positive photographic light-sensitive material comprising a support having thereon at least one internal latent image type silver halide emulsion layer not having been previously fogged, wherein the photographic light-sensitive material contains at least one nucleating agent represented by the formula (N-I) and at least one nucleating accelerating agent selected from compounds represented by the formulae (A-I) and/or (A-II):

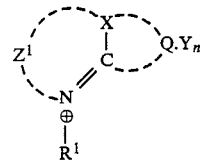

(N-I)

wherein $Z^1$ represents a non-metalic atomic group necessary to form a 5-membered or 6-membered heterocyclic ring to which an aromatic ring or a heterocyclic ring may further be condensed; $R^1$ represents an aliphatic group; X represents $$=\underset{|}{C}- \quad \text{or} \quad -\underset{|}{N}-;$$

Q represents a non-metallic atomic group necessary to form a 4-membered to 12 membered non-aromatic hydrocarbon ring or non-aromatic heterocyclic ring; at least one of $R^1$, a substituent for $Z^1$ and a substituent for Q includes an alkynyl group; Y represents a counter ion necessary for charge balance; and n represents a number necessary to balance a charge,

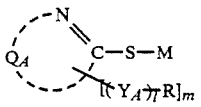

(A-I)

wherein $Q_A$ represents an atomic group necessary to form a 5-membered or 6-membered heterocyclic ring to which a carbocyclic aromatic ring or a heterocyclic aromatic ring may further be condensed; $Y_A$ represents a divalent linkage group comprising an atom or atomic group containing at least one of a hydrogen atom, a carbon atom, a nitrogen atom, an oxygen atom, and a sulfur atom; R represents an organic group containing at least one of a thioether group, an amino group, an ammonium group, an ether group, or a heterocyclic group; represents 0 or 1; m represents 0, 1 or 2; and M represents a hydrogen atom, an alkali metal atom, an ammonium group or a group capable of being cleaved under an alkaline condition,

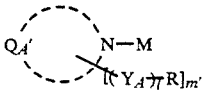

(A-II)

wherein $Q_A'$ represents an atomic group necessary to form a 5-membered or 6-membered heterocyclic ring which is capable of forming imino silver; $Y_A$, R, l and M each has the same meaning as defined in the general formula (A-I) above; and m' represents 1 or 2.

DETAILED DESCRIPTION OF THE INVENTION

The term "nucleating agent" as used herein means a substance which acts on an internal latent image type silver halide emulsion not having been previously fogged upon its surface development processing to form direct positive images.

The term "nucleating accelerating agent" as used herein means a substance which does not substantially act as the above-described nucleating agent but, rather, acts to accelerate the action of the nucleating agent to increase the maximum density of direct positive images and/or reduce the development time required to provide a predetermined direct positive image density.

The nucleating agent represented by the formula (N-I) is described in more detail below.

In the formula (N-I), at least one of $R^1$, $Z^1$ and Q may include a group capable of accelerating adsorption onto silver halide grains.

The heterocyclic ring (including the condensed ring) which is completed with $Z^1$ include, for example, a quinolinium nucleus, a benzimidazolium nucleus, a pyridinium nucleus, a thiazolium nucleus, a selenazolium nucleus, an imidazolium nucleus, a tetrazolium nucleus, an indolenium nucleus, a pyrrolinium nucleus, an acridinium nucleus, a phenanthridinium nucleus, an isoquinolium nucleus, and a naphthopyridinium nucleus.

The heterocyclic ring and condensed ring thereto which is completed with $Z^1$ may be substituted. Examples of the substituents include an alkyl group, an alkenyl group, an aralkyl group, an aryl group, an alkynyl group, a hydroxy group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonic acid ester group, a hydrazine group, a hydrazone group and an imino group.

As the substituent for $Z^1$, at least one is selected, for example, from the above-described substituents. When two or more substituents are present, they may be the same or different. The above-described substituents in turn may be further substituted with one or more of these substituents.

Further, the substituent for $Z^1$ may be a heterocyclic ring quaternary ammonium group completed with $Z^1$ via suitable linking group $L^1$. In this case, it forms a dimer structure.

The heterocyclic ring skeleton completed with $Z^1$ is preferably a quinolinium nucleus, a benzimidazolium nucleus,.a pyridinium nucleus, an acridinium nucleus, a phenanthridinium nucleus, a naphthopyridinium nucleus or an isoquinolinium nucleus, with a quinolinium nucleus, a naphthopyridinium nucleus and a benzimidazolium nucleus being more preferred and a quinolinium nucleus most preferred.

The aliphatic group represented by $R^1$ is preferably an unsubstituted alkyl group having from 1 to 18 carbon atoms or a substituted alkyl group having from 1 to 18 carbon atoms in the alkyl moiety. The substituents may be the same as those described for $Z^1$.

For $R^1$, an alkynyl group is preferred, and a propargyl group is particularly preferred.

Q represents an atomic group necessary to form a 4-membered to 12-membered nonaromatic hydrocarbon ring or nonaromatic heterocyclic ring. These rings may be substituted with one or more substituents as described for $Z^1$.

Examples of the nonaromatic hydrocarbon ring wherein X represents a carbon atom include a cyclopentane ring, a cyclohexane ring, a cyclohexene ring, a cycloheptane ring, an indan ring and a tetralin ring.

The nonaromatic heterocyclic ring includes, as a hetero atom, for example, a nitrogen atom, an oxygen atom, a sulfur atom and a selenium atom.

Examples of the nonaromatic heterocyclic ring wherein X represents a carbon atom include a tetrahydrofuran ring, a tetrahydropyran ring, a butyrolactone ring, a pyrrolidone ring and a tetrahydrothiophene ring.

Examples of the nonaromatic heterocyclic ring wherein X represents a nitrogen atom include a pyrrolidine ring, a piperidine ring, a pyridone ring, a piperazine ring, a perhydrothiazine ring, a tetrahydroquinoline ring and an indoline ring.

Preferred examples of the ring completed with Q are those wherein X represents a carbon atom. Particularly, a cyclopentane ring, a cyclohexane ring, a cycloheptane ring, a cyclohexene ring, an indan ring, a tetrahydropyran ring and a tetrahydrothiophene ring are preferred for the ring completed with Q.

The alkynyl group which is present in at least one on $R^1$, a substituent for $Z^1$ or a substituent for Q has been partially described and, to describe in more detail, an alkynyl group preferably contains from 2 to 18 carbon atoms and may be an ethynyl group, a propargyl group, a 2-butynyl group, a 1-methylpropargyl group, a 1,1-dimethylpropargyl group, a 3-butynyl group or a 4-pentynyl group.

These may further be substituted with those substituents which have been described as substituents for $Z^1$.

Of the alkynyl group, a propargyl group is preferred, and it is most preferred that $R^1$ is a propargyl group.

The group capable of accelerating adsorption onto silver halide grains which may be present in $R^1$, Q or $Z^1$ is preferably a group represented by the following formula:

$$X^1(L^1)_{m''}$$

wherein $X^1$ represents a group capable of accelerating adsorption onto Silver halide grains; $L^1$ represents a divalent linking group; and m'' represents 0 or 1.

Preferred examples of the group capable of accelerating adsorption onto silver halide represented by $X^1$ includes a thioamido group, a mercapto group and a 5-membered or 6-membered nitrogen-containing heterocyclic group. These groups may be substituted with one or more substituents as those described for $Z^1$. Of the thioamido group, an acyclic thioamido group (for example, thiourethane, thioureido) is preferred.

The mercapto group represented by $X^1$ is particularly preferably a heterocyclic mercapto group (for example, 5-mercaptotetrazole, 3-mercapto-1,2,4-triazole, 2-mercapto-1,3,4-thiadiazole, 2-mercapto-1,3,4-oxadiazole).

The 5-membered or 6-membered nitrogen-containing heterocyclic ring represented by $X^1$ contain a combination of nitrogen, oxygen, sulfur and carbon and preferably is one that will form an imino silver such as benzotriazole or aminothiatriazole.

The divalent linking group represented by $L^1$ in the above-described formula is an atom or atomic group containing at least one of C, N, S and O. Specifically, $L^1$ comprises an alkylene group, an alkenylene group, an alkynylene group, an arylene group, —O—, —S—, —NH—, —N=, —CO—, —$SO_2$—, (these groups optionally having one or more substituents), or a combination thereof. Specific examples of preferred combinations include $$-\overset{O}{\overset{\|}{C}}O-,\ -\overset{O}{\overset{\|}{C}}NH-,\ -SO_2NH-,\ -O\overset{O}{\overset{\|}{C}}NH-,\ -NH\overset{O}{\overset{\|}{C}}NH-,$$

$$-NHSO_2NH-\ \text{-(alkylene)-}\overset{O}{\overset{\|}{C}}NH-,\ \text{-(arylene)-}SO_2NH-,$$

$$\text{-(arylene)-}NH\overset{O}{\overset{\|}{C}}NH-\ \text{and}\ \text{-(arylene)-}\overset{O}{\overset{\|}{C}}NH-.$$

The counter ion for charge balance represented by Y includes a bromide ion, a chloride ion, an iodide ion, a p-toluenesulfonate ion, an ethylsulfonate ion, a perchlorate ion, a trifluoromethanesulfonate ion, a thiocyanate ion, a $BF_4$— ion and a $PF_6$— ion.

Of the compounds represented by the general formula (N-I), those having a group capable of accelerating adsorption onto silver halide grains are preferred. Particularly, those having a thioamido group, an azole group or a heterocyclic mercapto group, as the adsorption accelerating group represented by $X^1$ are more preferred.

Examples of these compounds and synthetic methods therefor are described, for example, in Japanese Patent Application No. 62-17984 and the patents and literature cited therein.

Specific examples of the compounds represented by the general formula (N-1) are set forth below, but the present invention is not to be construed as being limited to these compounds.

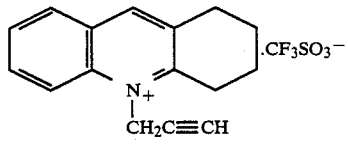

(N-I-1)

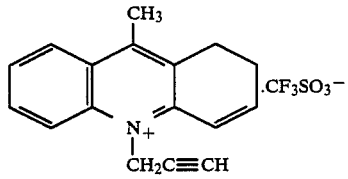

(N-I-2)

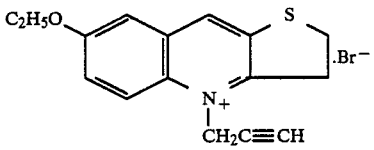

(N-I-3)

-continued
(N-I-4)
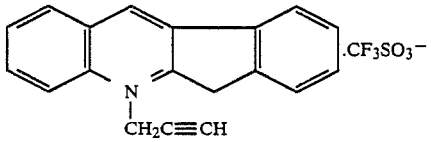
(N-I-5)
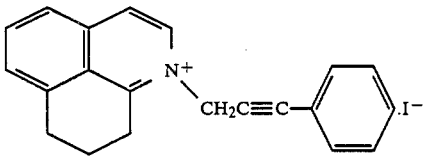
(N-I-6)
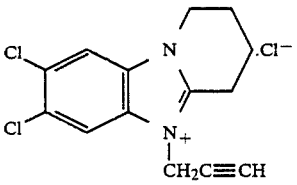
(N-I-7)
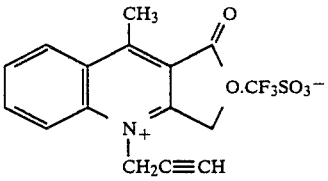
(N-I-8)
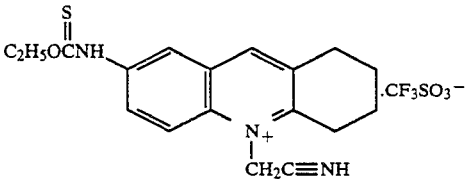
(N-I-9)
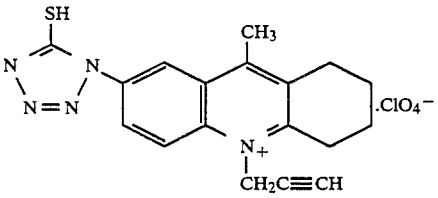
(N-I-10)
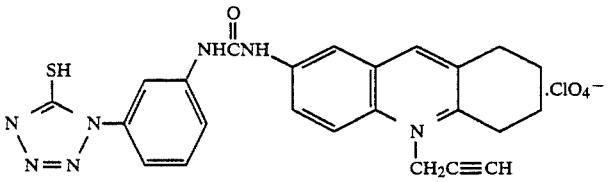
(N-I-11)
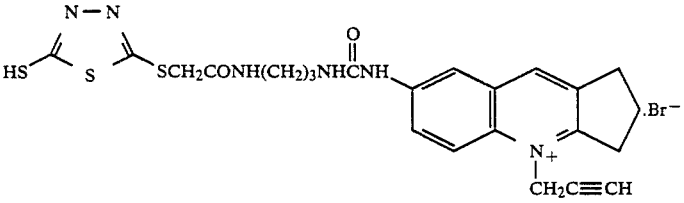

-continued
(N-I-12)
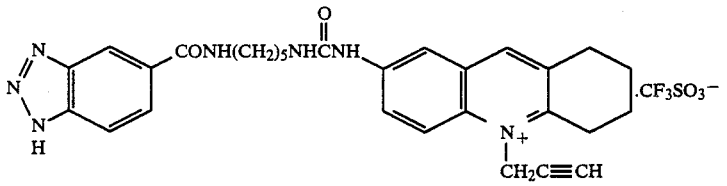
(N-I-13)
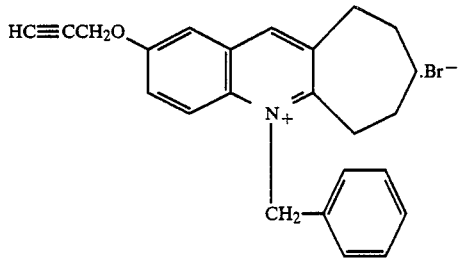
(N-I-14)
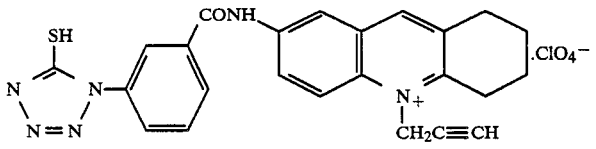
(N-I-15)
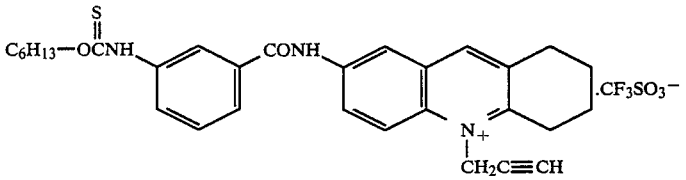
(N-I-16)
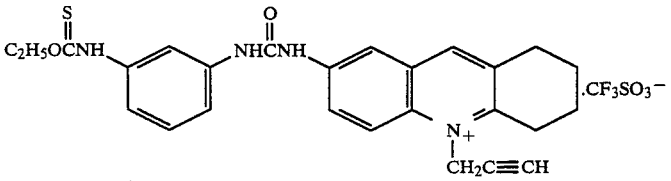
(N-I-17)
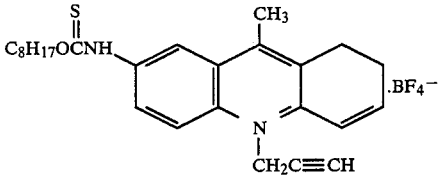
(N-I-18)
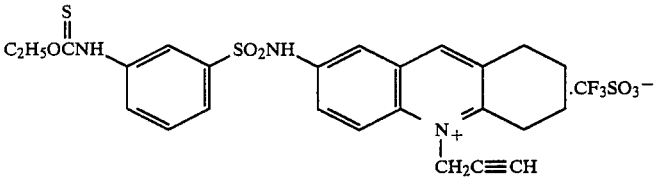
(N-I-19)
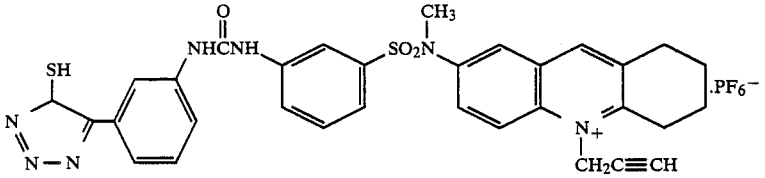

-continued

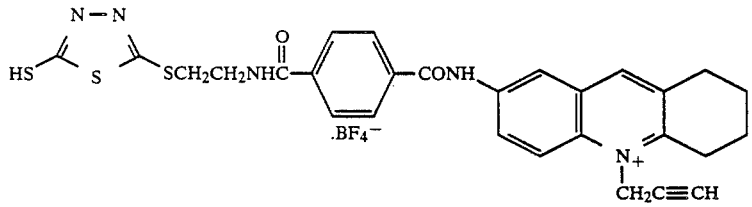
(N-I-20)

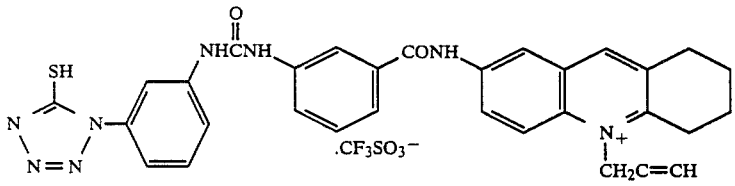
(N-I-21)

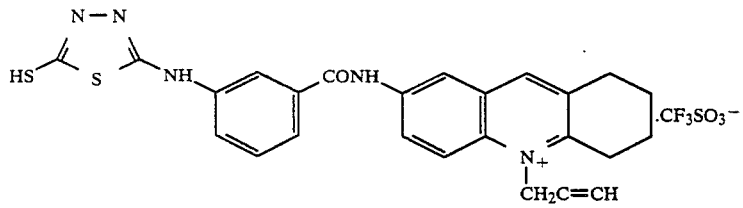
(N-I-22)

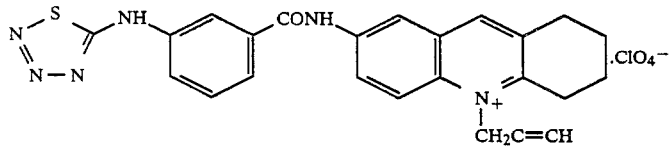
(N-I-23)

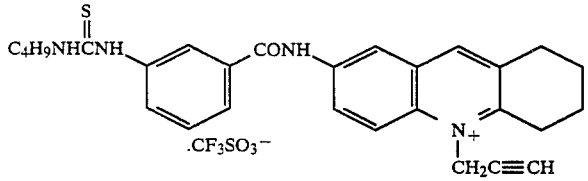
(N-I-24)

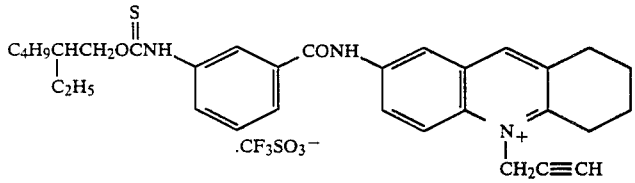
(N-I-25)

In the case of incorporating the compound represented by the general formula (N-I) described above in a photographic light-sensitive material according to the present invention, it suffices to add the compound to a hydrophilic colloidal solution as a solution in a water-miscible organic solvent such as an alcohol (e.g., methanol, ethanol), an ester (e.g., ethyl acetate) or a ketone (e.g., acetone), or, where the compound is water-soluble, as an aqueous solution.

In adding the compound to the photographic emulsion, the addition may be made at any stage from the initiation of chemical ripening to the stage before coating, with the stage after completion of chemical ripening being preferable.

In the present invention, the nucleating agent represented by the general formula (N-I) may be incorporated in a hydrophilic colloidal layer adjacent to a silver halide emulsion layer, but is preferably incorporated in a silver halide emulsion. The amount of the agent to be added can vary over a wide range since it varies depending upon the properties of silver halide emulsion which is actually used, the chemical structure of the nucleating agent, and the developing conditions. However, the nucleating agent is usefully added in an amount of from about $1\times10^{-8}$ mol to about $1\times10^{-2}$ mol per mol of silver in the silver halide emulsion, preferably from about $1\times10^{-7}$ mol to about $1\times10^{-3}$ mol per mol of silver in the silver halide emulsion.

In the following, the compounds represented by the formula (A-I) or (A-II) are described in more detail.

In the general formula (A-I), $Q_A$ represents an atomic group necessary to form a 5-membered or 6-membered heterocyclic ring comprising at least one atom selected from the group consisting of a carbon atom, a nitrogen atom, an oxygen atom, a sulfur atom and a selenium atom. The heterocyclic ring may be condensed with a carbocyclic aromatic ring or heterocyclic aromatic ring.

Examples of such a heterocyclic ring include a tetrazole, a triazole, an imidazole, a thiadiazole, an oxadiazole, a selenadiazole, an oxazole, a thiazole, a benzoxazole, a benzothiazole, a benzimidazole, and a pyrimidine.

The above described heterocyclic ring may be substituted with a nitro group, a halogen atom (for example, chlorine and bromine), a mercapto group, a cyano group, a substituted or unsubstituted alkyl group (for example, methyl, ethyl, propyl, t-butyl, and cyanoethyl), a substituted or unsubstituted aryl group (for example, phenyl, 4-methanesulfonamidophenyl, 4-methylphenyl, 3,4-dichlorophenyl and a naphthyl), a substituted or unsubstituted alkenyl group (for example, allyl), a substituted or unsubstituted aralkyl group (for example, benzyl, 4-methylbenzyl and phenethyl), a sulfonyl group (for example, methanesulfonyl, ethane sulfonyl and p-toluenesulfonyl), a carbamoyl group (for example, unsubstituted carbamoyl, methylcarbamoyl and phenylcarbamoyl), a sulfamoyl group (for example, unsubstituted sulfamoyl, methylsulfamoyl and phenylsulfamoyl), a carbonamido group (for example, acetamido and a benzamido), a sulfonamido group (for example, methanesulfonamido, benzenesulfonamido and p-toluenesulfonamido), an acyloxy group (for example, acetyloxy and benzoyloxy), a sulfonyloxy group (for example, methanesulfonyloxy), a ureido group (for example, unsubstituted ureido, methylureido, ethylureido and phenylureido), a thioureido group (for example, unsubstituted thioureido and methylthioureido), an acyl group (for example, acetyl and benzoyl), an oxycarbonyl group (for example, methoxycarbonyl and phenoxycarbonyl), an oxycarbonylamino group (for example, methoxycarbonylamino, phenoxycarbonylamino and 2-ethylhexyloxycarbonylamino), a carboxylic acid or a salt thereof, a sulfonic acid or a salt thereof, or a hydroxy group. However, the heterocyclic ring preferably is not substituted with a carboxylic acid or a salt thereof, a sulfonic acid or a salt thereof, or a hydroxy group in view of the effect of accelerating nucleation.

Preferred examples of the heterocyclic ring represented by $Q_A$ include a tetrazole, a triazole, an imidazole, a thiadiazole, and an oxadiazole.

$Y_A$ represents a divalent linkage group comprising an atom or atomic group containing at least one of a hydrogen atom, a carbon atom, a nitrogen atom, an oxygen atom and a sulfur atom. Examples of such a divalent linkage group include —S—, —O—,

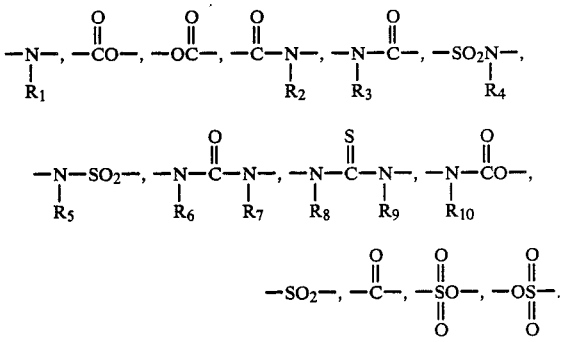

In the above formulae, $R_1$, $R_2$, $R_3$, $R_4$, $R_5$, $R_6$, $R_7$, $R_8$, $R_9$ and $R_{10}$ each represents a hydrogen atom, a substituted or unsubstituted alkyl group (for example, methyl, ethyl, propyl and n-butyl), a substituted or unsubstituted aryl group (for example, phenyl and 2-methylphenyl), a substituted or unsubstituted alkenyl group (for example, propenyl and 1-methylvinyl), or a substituted or unsubstituted aralkyl group (for example, benzyl and phenethyl).

These linkage groups may be connected through a straight chain or branched chain alkylene group (for example, methylene, ethylene, propylene, butylene, hexylene, and 1-methylethylene) or a substituted or unsubstituted arylene group (for example, phenylene, and naphthylene) to R or a heterocyclic ring described below.

R represents an organic group containing at least one of a thioether group, an amino group (including a salt thereof), an ammonium group, an ether group or a heterocyclic group (including a salt thereof).

Examples of the organic group include groups obtained by combining a group selected from a substituted or unsubstituted alkyl group, a substituted or unsubstituted alkenyl group, a substituted or unsubstituted aralkyl group, and a substituted or unsubstituted aryl group with a thioether group, an amino group, an ammonium group, an ether group, or a heterocyclic group as described above. Combinations of such organic groups may be used. Specific examples of such organic groups include a dimethylaminoethyl group, an aminoethyl group, a diethylaminoethyl group, a dibutylaminoethyl group, a dimethylaminopropyl hydrochloride group, a dimethylaminoethylthioethyl group, a 4-dimethylaminophenyl group, a 4-dimethylaminobenzyl group, a methylthioethyl group, an ethylthiopropyl group, a 4-methylthio-3-cyanophenyl group, a methylthiomethyl group, a trimethylammonioethyl group, a methoxyethyl group, a methoxyethoxyethoxyethyl group, a methoxyethylthioethyl group, a 3,4-dimethoxyphenyl group, a 3-chloro-4-methoxyphenyl group, a morpholinoethyl group, a 1-imidazolylethyl group, a morpholinoethylthioethyl group, a pyrrolidinoethyl group, a piperidinopropyl group, a 2-pyridylmethyl group, a 2-(1-imidazolyl)ethylthioethyl group, a pyrazolylethyl group, a triazolylethyl group, and a methoxyethoxyethoxyethoxycarbonylaminoethyl group.

In the general formula (A-I), l represents 0 or 1, and m represents 0, 1 or 2.

M represents a hydrogen atom, an alkali metal atom (for example, sodium and potassium), an ammonium group (for example, trimethylammonium and dimethylbenzylammonium) or a group which undergoes cleavage under an alkaline condition to become a hydrogen atom or an alkali metal atom for M (for example, acetyl, cyanoethyl, and methanesulfonylethyl).

In the general formula (A-II), $Y_A$, R, l and M each has the same meaning as defined for the general formula (A-I); m' represents 1 or 2; and $Q_A'$ represents an atomic group necessary to form a 5 membered or 6-membered heterocyclic ring which is capable of forming imino silver, preferably an atomic group necessary to form a 5-membered or 6-membered heterocyclic ring comprising at least one atom selected from the group consisting of a carbon atom, a nitrogen atom, an oxygen atom, a sulfur atom and a selenium atom. The heterocyclic ring may be condensed with a carbocyclic aromatic ring or heterocyclic aromatic ring.

Examples of the heterocyclic ring formed by $Q_A'$ include an indazole, a benzimidazole, a benzotriazole, a benzoxazole, a benzothiazole, an imidazole, a thiazole, an oxazole, a triazole, a tetrazole, a tetraazaindene, a triazaindene, a diazaindene, a pyrazole, and an indole.

Of the compounds represented by the formula (A-I) or (A II), those represented by the formula (A-III), (A-IV), (A-V), (A-VI) or (A-VII) described below are preferably employed.

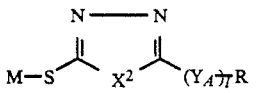

(A-III)

wherein M, R, $Y_A$ and l each has the same meaning as defined in the formula (A-I); and $X^2$ represents an oxygen atom, a sulfur atom or a selenium atom, preferably a sulfur atom,

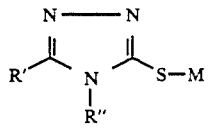

(A-IV)

wherein R′ represents a hydrogen atom, a halogen atom (for example, chlorine, bromine), a nitro group, a mercapto group, an unsubstituted amino group, a substituted or unsubstituted alkyl group (for example, methyl, ethyl), a substituted or unsubstituted alkenyl group (for example, propenyl, 1-methylvinyl), a substituted or unsubstituted aralkyl group (for example, benzyl, phenethyl), a substituted or unsubstituted aryl group (for example, phenylm 2-methylphenyl) or $-(Y_A)_l-R''$ represents a hydrogen atom, an unsubstituted amino group or $-(Y_A)_l-R$, when both R′ and R″ represent $-(Y_A)_l-R$, they may be the same or different, provided that at least one of R′ and R″ represents $-(Y_A)_l-R$; and M, R, $Y_A$ and l each has the same meaning as defined for the formula (A-I),

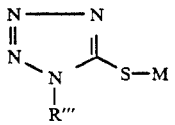

(A-V)

wherein R‴ represent $-(Y_A)_l-R$; and M, R, $Y_A$ and l each has the same meaning as defined for the formula (A-I),

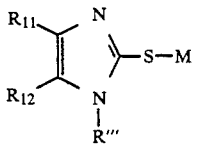

(A-VI)

wherein $R_{11}$ and $R_{12}$, which may be the same or different, each represents a hydrogen atom, a halOgen atom (for example, chlorine, bromine), a substituted or unsubstituted amino group, a nitro group, a substituted or unsubstituted alkyl group (for example, methyl, ethyl), a substituted or unsubstituted alkenyl group (for example, propenyl, 1-methylvinyl), a substituted or unsubstituted aralkyl group (for example, benzyl, phenethyl) or a substituted or unsubstituted aryl group (for example, phenyl, 2-methylphenyl); R‴ represents $-(Y_A)_l-R$; and M, R, $Y_A$ and l each has the same meaning as defined in the general formula (A-V), Compound (A-VII) such as a tetraazaindene, triazaindene or pentaazindene each having at least one mercapto group).

Specific examples of the compound represented by the general formulae (A-I) to (A-VI) and Compound (A-VII) are set forth hereinafter, but the present invention should not be construed as being limited thereto.

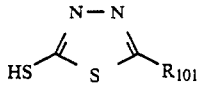

| No. | $R_{101}$ |
|---|---|
| A-1 | $-SCH_3$ |
| A-2 | $-S(CH_2)_3N(CH_3)_2.HCl$ |
| A-3 | 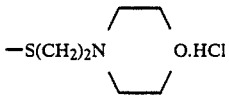 |
| A-4 | $-S(CH_2)_2OCH_3$ |
| A-5 | $-SCH_2SCH_3$ |
| A-6 | $-S(CH_2)_6N(CH_3)_2.HCl$ |
| A-7 | $-S(CH_2)_6N(C_2H_5)_2.HCl$ |
| A-8 | $-S(CH_2)_2S(CH_2)_2N(CH_3)_2.HCl$ |
| A-9 | 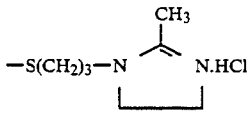 |
| A-10 | $-S(CH_2)_2\overset{\oplus}{N}(CH_3)_3.Cl^{\ominus}$ |
| A-11 | $-S(CH_2)_2NHCH_3.HCl$ |

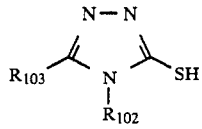

| No. | $R_{102}$ | $R_{103}$ |
|---|---|---|
| A-12 | 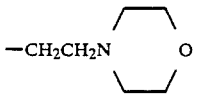 | H |
| A-13 | $-CH_3$ | H |
| A-14 | 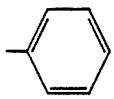 | H |
| A-15 | $-CH_2CH_2N(C_2H_5)_2$ | H |
| A-16 | $-CH_2CH_2N(C_3)_2$ | H |
| A-17 | $-CH_3$ | $CH_3OCH_2$ |
| A-18 | 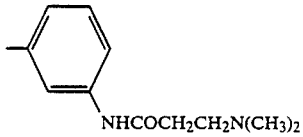 | H |
| A-19 | 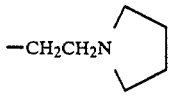 | H |

-continued

A-20

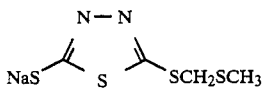

A-21

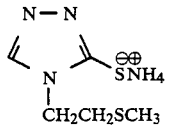

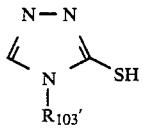

| No. | $R_{103}'$ |
|---|---|
| A-22 | $-(CH_2)_2S(CH_2)_2N(CH_3)_2$ |
| A-23 | $-(CH_2)_2N(C_3H_{7-n})_2$ |
| A-24 | $-(CH_2)_3N(CH$ |
| A-25 | $-(CH_2)_2\overset{\oplus}{N}(CH_3)_3.Cl^{\ominus}$ |

A-26

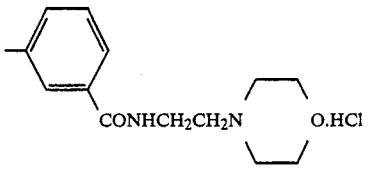

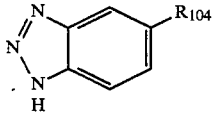

| No. | $R_{104}$ |
|---|---|
| A-27 | $-OCNH(CH_2)_2N(CH_3)_2$ |
| A-28 | $-OCNH(CH_2)_2SCH_3$ |

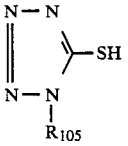

| No. | $R_{105}$ |
|---|---|
| A-29 | $-CH_3$ |
| A-30 | $-(CH_2)_2N(C_3H_{7-n})_2$ |
| A-31 | $-(CH_2)_2N(C_2H_5)_2$ |
| A-32 | $-(CH_2)_2O-CH_3$ |

A-33

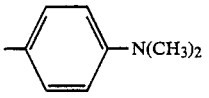

A-34

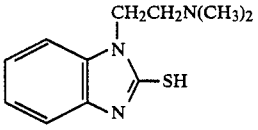

A-35

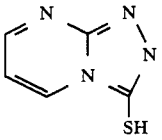

-continued

A-36

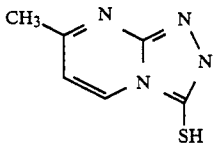

A-37

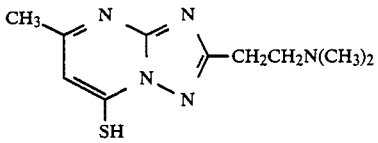

A-38

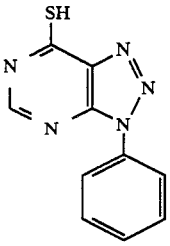

A-39

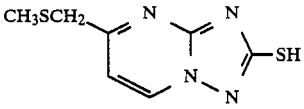

A-40

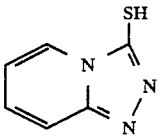

The nucleating acclerating agent described above used in the present invention is incorporated by dissolving in an appropriate solvent such as water, methanol, and dimethylformamide into the photographic light-sensitive material, and preferably incorporated into an internal latent image type silver halide emulsion layer or other hydrophilic colloid layer (for example, an intermediate layer or a protective layer). Particularly preferably, the nucleation accelerating agent is incorporated into a silver halide emulsion layer or an adjacent layer thereto The amount of the nucleation accelerating agent added is preferably about $10^{-6}$ to about $10^{-2}$ mol, more preferably about $10^{-5}$ to about $10^{-2}$ mol per mol of silver halide.

Further, two or more nucleation accelerating agents can be employed in combination.

The internal latent image type silver halide emulsion not having been previously fogged which can be used in the present invention includes an emulsion containing silver halide grains whose surfaces have not been previously fogged, and which form latent images predominantly internally. More specifically, suitable emulsions have the characteristic that when coated on a transparent support in a predetermined amount ranging from 0.5 $g/m^2$ to 3 $g/m^2$ in terms of silver, exposed for a fixed time between 0.01 and 10 seconds, then developed at 18° C. for 5 minutes in the following developing solution A (internal developer), provide a maximum density (measured by a conventional photographic density measuring method) of at least about 5 times, more preferably at least about 10 times, as much as that obtained by coating and exposing the emulsion in the same manner as described above, but developing at 20° C. for 6 minutes in the following developing solution B (surface developer):

| | |
|---|---|
| Internal developer A | |
| Metol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water to make | 1 liter |
| Surface developer B | |
| Metol | 2.5 g |
| l-Ascorbic acid | 10 g |
| $NaBO_2.4H_2O$ | 35 g |
| KBr | 1 g |
| Water to make | 1 liter |

Specific examples of the internal latent image type emulsions include conversion type silver halide emulsions as described, for example, in U.S. Pat. No. 2,592,250, and core/shell type silver halide emulsions as described, for example, in U.S. Pat. Nos. 3,761,276, 3,850,637, 3,923,513, 4,035,185, 4,395,478 and 4,504,570, JP-A-52-156614, JP-A-55-127549, JP-A-53-60222, JP-A-56-22681, JP-A-59-208540, JP-A-60-107641, JP-A-61-3137, JP-A-62-215272 and the patents cited in *Research Disclosure,* No. 23510 (November, 1983), p. 236.

The silver halide grains used in the present invention may be regular crystals such as cubic, octahedral, dodecahedral or tetradecahedral crystals, irregular crystals such as spherical crystals, or tabular grains whose length/thickness ratio is 5 or more. A composite form of these crystal forms may be used, and an emulsion made up of a mixture of these crystals may also be used.

The composition of the silver halide includes silver chloride, silver bromide or mixed silver halides, and the silver halide preferably used in the present invention is either free from silver iodide, or if it contains a silver iodide, it is silver chloro(iodo)bromide, silver (iodo)-chloride or silver (iodo)bromide containing 3 mol% or less of silver iodide.

The average grain size of the silver halide grains is preferably up to 2 μm from 0.1 μm, more preferably from 0.15 μm to 1 μm. Although the distribution of the grain size may be wide or narrow, in order to improve graininess, sharpness, etc., it is preferred in the present invention to use a so-called "monodispersed" silver halide emulsion having a narrow grain size distribution such that 90% or more of all the grains fall within ±40%, preferably ±20%, of the average grain size, in terms of grain number or weight.

In order to satisfy the gradation required for the photographic light-sensitive material, in emulsion layers having substantially the same color sensitivity, two or more monodispersed silver halide emulsions different in grain size or a plurality of grains of the same size but different in sensitivity are mixed in the same layer or are applied as different layers that are superposed. Further, two or more polydispersed silver halide emulsions or a monodispersed silver halide emulsion and a polydispersed silver halide emulsion can be used in the form of a mixture or in superposed layers.

In the silver halide emulsion used in the present invention, the interior or the surface of the grains may be chemically sensitized by sulfur sensitization, selenium sensitization, reduction sensitization or noble metal sensitization, that can be used alone or in combination. Specific examples of useful chemical sensitization are described, for example, in the patents cited in *Research Disclosure,* No. 17643, Item III (December, 1978), page 23, etc.

The photographic emulsion used in the present invention is spectrally sensitized with a photographic sensitizing dye in a conventional manner. Particularly useful dyes are cyanine dyes, merocyanine dyes and complex merocyanine dyes, which may be used alone or in combination, and also can be used in combination with supersensitizers. Specific examples thereof are described, for example, in the patents cited in *Research Disclosure,* No. 17643, Item IV (December, 1978), pages 23 to 24.

The photographic emulsions used in the present invention can contain an antifoggant or a stabilizer for the purpose of stabilizing the photographic performance, or of preventing formation of fog during the production, storage or photographic processing of the photographic light-sensitive material. Specific examples of antifoggants and stabilizers are described, for example, in *Research disclosure,* No. 17643, Item VI (December, 1978), and E. J Birr, *Stabilization of Photographic Silver Halide Emulsion,* 1974 (Focal Press).

In order to form direct positive color images according to the present invention, various color couplers can be employed. Useful color couplers are compounds that can undergo a coupling reaction with an oxidation product of an aromatic primary amine type color developing agent to produce or release a dye substantially non-diffusible and that themselves are preferably substantially non-diffusible. Typical examples of useful color couplers include naphtholic or phenolic compounds, pyrazolone or pyrazoloazole compounds and open chain or heterocyclic ketomethylene compounds. Specific examples of these cyan, magenta and yellow couplers which can be used in the present invention are compounds as described, for example, in *Research Disclosure,* No. 17643 (December, 1978), page 25, Item VII-D; ibid., No. 18717 (November, 1979) and JP-A-62-215272, and compounds described in the patents cited therein.

Among others, typical yellow couplers that can be used in the present invention include yellow two-equivalent couplers of oxygen atom releasing or nitrogen atom releasing type. Particularly, α-pivaloylacetanilide type couplers are excellent in fastness, in particular light fastness, of the dyes formed therefrom, while α-benzoylacetanilide type couplers are preferred because a high color density can be obtained.

5-Pyrazolone type magenta couplers preferably used in the present invention are 5-pyrazolone type couplers (particularly, sulfur atom releasing type two-equivalent couplers, substituted at the 3-position with an arylamino group or an acylamino group.

Pyrazoloazole type couplers are further preferred. Among them, pyrazolo[5,1-c][1,2,4]triazoles as described in U.S. Pat. No. 3,725,067 are preferred, imidazo[1,2-b]pyrazoles as described in U.S. Pat. No. 4,500,630 are more preferred in view of the light fastness and the low yellow subsidiary absorption of the dye formed therefrom, and pyrazolo[1,5-b][1,2,4]triazoles as described in U.S. Pat. No. 4,540,654 are particularly preferred.

Cyan couplers preferably used in the present invention include naphtholic and phenolic couplers as described, for example, in U.S. Pat. Nos. 2,474,293 and 4,502,212 and phenolic cyan couplers having an alkyl group containing two or more carbon atoms at the m-position of the phenol nucleus as described in U.S. Pat. No. 3,772,002. In addition, 2,5-diacylamino-substituted phenolic couplers are also preferred in view of fastness of color image formed therefrom.

Colored couplers for correcting undesired absorption in the short wavelength range of produced dyes; couplers capable of forming dyes with appropriate diffusibility; non-color forming couplers; DIR couplers that can release a development inhibitor as a result of the coupling reaction; and polymerized couplers can also be used.

Generally, the amount of a color coupler used is in the range of from 0.001 to 1 mol per mol of a light-sensitive silver halide, and preferably in the case of a yellow coupler the amount is from 0.01 to 0.5 mol per mol of a light-sensitive silver halide, in the case of a magenta coupler the amount is from 0.03 to 0.5 mol per mol of a light-sensitive silver halide, and in the case of a cyan coupler the amount is from 0.002 to 0.5 mol per mol of a light-sensitive silver halide.

In the present invention, a color formation reinforcing agent can be employed for the purpose of increasing the color forming property of a coupler. Representative examples of such compounds are described in JP-A-62-215272, pages 374 to 391.

The couplers used in the present invention are dissolved in an organic solvent having a high boiling point and/or an organic solvent having a low boiling point, the solution is finely emulsified and/or dispersed in an aqueous solution of gelatin or other hydrophilic colloids by means of high speed agitation using a homogenizer, etc., mechanical procedure using a colloid mill, etc. or technique using ultrasonic wave, and then the emulsified dispersion is mixed with a photographic emulsion, followed by coating to form a layer. In this case, although it is not always necessary to employ an organic solvent having a high boiling point, it is preferred to use such an organic solvent having a high boiling point, specific examples of which include the compounds as described in JP-A-62-215272, pages 440 to 467.

The couplers used in the present invention can be dispersed in a hydrophilic colloid according to the methods as described in JP-A-62-215272, pages 468 to 475.

The photographic light-sensitive material in accordance with the present invention may contain, as a color fog preventing agent or color mixing preventing agent, hydroquinone derivatives, aminophenol derivatives, amines, gallic acid derivatives, catechol derivatives, ascorbic acid derivatives, non-color forming couplers, sulfonamidophenol derivatives, etc. Typical examples of color fog preventing agents and color mixing preventing agents are described in JP-A-62-215272, pages 600 to 663.

In the photographic light-sensitive material of the present invention, various color fading preventing agents can be used. Typical organic color fading preventing agents include hydroquinones, 6-hydroxychromans, 5-hydroxycoumarans, sprochromans, p-alokoxyphenols, hindered phenols including bisphenols, gallic acid derivatives, methylenedioxybenzenes, aminophenols, hindered amines, and ether or ester derivatives obtained by the silylation or alkylation of the phenolic hydroxyl group of these compounds. Further, metal complexes such as (bissalicylalkoxymato)nickel complex and (bis-N,N-dialkyldithiocarbamato)nickel complexes can be used.

For the purpose of preventing yellow dye images from being deteriorated by heat, humidity and light, compounds having both a hindered amine and a hindered phenol in a single molecule, as described in U.S. Pat. No. 4,268,593, give good results. For the purpose of preventing magenta dye images from being deteriorated, particularly by light, spiroindanes as described in JP-A-56-159644 and chromans substituted with hydroquinone diethers or monoethers as described in JP-A-55-89835 give good results.

Typical examples of these color fading preventing agents are described in JP-A-62-215272, pages 401 to 440. The desired aim can be attained when these compounds are added to light-sensitive layers generally in amounts of 5 to 100 wt% based on the respective color couplers by co-emulsifying them with the couplers.

For the purpose of preventing cyan dye images from being deteriorated by heat and, particularly, light, it is effective to introduce an ultraviolet light absorbing agent into both layers adjacent to a cyan color forming layer. An ultraviolet light, absorbing agent can also be added to a hydrophilic colloid layer such as a protective layer. Typical examples of such compounds are described in JP-A-62-215272, pages 391 to 400.

As binders or protective colloids which can be used in emulsion layers and intermediate layers of the photographic light-sensitive material of the present invention, it is advantageous to use gelatin, but other hydrophilic colloids than gelatin can also be used.

The photographic light-sensitive material of the present invention can contain dyes for preventing irradiation or halation, ultraviolet light absorbing agents, plasticizers, fluorescent brightening agents, matting agents, aerial fog preventing agents, coating aids, hardening agents, antistatic agents, lubricants, etc. Typical examples of these additives are described in *Research Disclosure,* No. 17643, Items VIII to XIII (December, 1978), pages 25 to 27, ibid., No. 18716 (November, 1979), pages 647 to 651.

The present invention can be applied to multilayer multicolor photographic materials having at least two layers having different spectral sensitivities on a support. Generally, a multilayer natural color photographic material has at least one red-sensitive emulsion layer, at least one green-sensitive emulsion layer and at least one blue-sensitive emulsion layer on a support. The order of these layers is appropriately selected as desired. In a preferred order of the layers, a red-sensitive emulsion layer, a green-sensitive emulsion layer and a blue-sensitive emulsion layer are coated in that order on a support or a green sensitive emulsion layer, a red-sensitive emulsion layer and a blue-sensitive emulsion layer are coated in that order on a support. Each of these emulsion layers may consist of two or more emulsion layers different in sensitivity, or may consist of two or more emulsion layers having the same sensitivity with a light-insensitive layer between them. Generally, the red-sensitive emulsion layer contains a cyan forming coupler, the green-sensitive emulsion layer contains a magenta forming coupler and the blue-sensitive emulsion layer contains a yellow forming coupler, but in some cases the combination can be changed.

For the purpose of increasing maximum image density, of reducing minimum image density, of improving preservability of the photographic light-sensitive material, and of quickening the development, the following compounds can be added: hydroquinones (e.g., compounds as described in U.S. Pat. Nos. 3,227,552 and 4,279,987); chromans (e.g., compounds as described in U.S. Pat. No. 4,268,621, JP-A-54-103031 and *Research Disclosure,* No. 18264 (June, 1979), pages 333 to 334); quinones (e.g., compounds as described in *Research Disclosure,* No. 21206 (December, 1981), pages 433 to 434); amines (e.g., compounds as described in U.S. Pat. No. 4,150,993 and JP-A-58-174757; oxidizing agents (e.g., compounds as described in JP-A-60-260039 and *Research Disclosure,* No. 16936 (May, 1978), pages 10 to 11); catechols (e.g., compounds as described in JP-A-55-21013 and JP-A-55-65944); compounds capable of releasing a nucleating agent at the time of development (e.g., compounds as described in JP-A-60-107029); thioureas (e.g., compounds as described in JP-A-60-95533); and spirobisindanes (e.g., compounds as described in JP-A-55-65944).

It is preferable that the photographic light-sensitive material according to the invention is provided with suitable auxiliary layers such as a protective layer, an intermediate layer, a filter layer, an antihalation layer, a backing layer and a white reflective layer, in addition to the silver halide emulsion layers.

In the photographic light-sensitive materials of the present invention, the photographic emulsion layers and other layers are applied on supports as described in *Research Disclosure,* No. 17643, Item XVII (December, 978), page 28, European Patent No. 0,182,253, and JP-A-61-7655. The coating methods as described in *Research Disclosure,* No. 17643, Item XV, pages 28 to 29 can be employed.

The present invention may be applied to various types of color photographic light-sensitive materials.

For instance, color reversal films for slides and television, color reversal papers, instant color films, etc. are typical examples. In addition, the present invention may be applied to color hard copies for preserving images of full color copiers or CRT. The present invention is also applicable to black-and-white photographic light-sensitive materials utilizing mixing of three color couplers, as described in *Research Disclosure,* No. 17123 (July, 1978), etc.

Furthermore, the present invention can be applied to black-and-white photographic light-sensitive materials. Examples of the black-and-white (B/W) photographic light-sensitive materials to which the present invention can be applied include B/W direct positive photographic light-sensitive materials (for example, photographic materials for X-ray, for duplication, for micrography, for photocomposing, and for printing, etc.) as described, for example, in JP-A-59-208540 and JP-A-60-260039.

When using the photographic light-sensitive material of the present invention for a color diffusion transfer process, coloring materials which themselves are non-diffusible (immobile) in an alkaline solution (developing solution) but, as a result of development, release a diffusible dye (or its precursor) are advantageously used, while dye developers may be employed as coloring materials. Suitable diffusible dye-releasing type coloring materials (DRR compounds) include couplers and redox compounds capable of releasing a diffusible dye. These compounds are useful not only for photographic materials of color diffusion transfer processes (wet processes), but also for photographic materials of thermal developing processes (dry processes) as described, for example, in JP-A-58-58543.

The diffusible dye-releasing redox compounds (hereinafter referred to as "DRR compounds") can be represented by the following general formula:

(Ballast) - (Redox-cleavable atomic group) - D

In the above formula, Ballast and Redox-cleavable atomic group may be those compounds which are described in JP-A-58-163938, pages 12 to 22. D represents a dye (or its precursor) moiety. This dye or dye precursor moiety may be bound to the Redox-cleavable atomic group through a linking group. As the dye moiety represented by D, those which are described in the following literature references are effective: Examples of yellow dyes:

Those which are described in U.S. Pat. Nos. 3,597,200, 3,309,199, 4,013,633, 4,245,028, 4,156,609, 4,139,383, 4,195,992, 4,148,641, 4,148,643 and 4,366,322, JP-A-51-114930, JP-A-56-71072, *Research Disclosure,* No. 17630 (1978) and ibid., No. 16475 (1977).

Examples of magenta dyes:

Those which are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060 and JP-A-55-134.

Examples of cyan dyes:

Those which are described in U.S. Pat. Nos. 3,482,972, 3,929,760, 4,013,635, 4,268,625, 4,171,220, 4,242,435, 4,142,891, 4,195,994, 4,147,544 and 4,148,642, British Patent No. 1,551,138, JP-A-54-99431, JP-A-52-8827, JP-A-53-47823, JP-A-53-143323, JP-A-54-99431, JP-A-56-71061, European Patents 53,037 and 53,040, *Research Disclosure,* No. 17630 (1978) and ibid., No. 6475 (1977).

These compounds are ordinarily coated in amounts of from about $1\times10^{-4}$ to about $1\times10^{-2}$ mol/m$^2$, preferably from about $2\times10^{-4}$ to $2\times10^{-2}$ mol/m$^2$.

In the present invention, these coloring materials may be incorporated into the silver halide emulsion layer associated with them, or in an adjacent layer to the emulsion layer on the exposure side or on the opposite side.

In the case of using the photographic light-sensitive material of the present invention for a color diffusion transfer process, the photographic emulsions may be coated on the same support as image-receiving layers, or may be coated on different supports. The silver halide photographic emulsion layers (light-sensitive element) and the image-receiving layers (image-receiving element) may be provided in a combined form as a film unit, or may be provided as separate and independent photographic materials. As the form of such a film unit, those which are kept together throughout the steps of exposure, development, transfer, and viewing the diffused image obtained or those which are peeled apart after development may be employed, with the latter type being more effective in accordance with the present invention.

A color developing solution which can be used in development processing of the color photographic light-sensitive material according to the present invention is an alkaline aqueous solution containing preferably an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or sulfate, hydrochloride, p-toluenesulfonate thereof, etc.

Two or more kinds of color developing agents may be employed in a combination thereof, depending on the purpose.

The pH of the color developing solution used is ordinarily in a range from 9 to 12, preferably in a range from 9.5 to 11.5.

After color development, the photographic emulsion layers are usually subjected to a bleach processing. The bleach processing can be performed simultaneously with a fix processing (bleach-fix processing), or it can be performed independently from the fix processing. Further, for the purpose of performing a rapid processing, a processing method wherein after a bleach processing a bleach-fix processing is conducted may be employed. Moreover, it may be appropriately practiced depending on the purpose to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III), cobalt(III), chromium(VI), copper(II), etc; peracids; quinones; nitro compounds; etc. Representative examples of the bleaching agents include ferricyanides; dichloromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid), or complex salts of organic acids (such as citric acid, tartaric acid, malic acid); persulfates; bromates; permanganates; nitrobenzenes; etc. Of these compounds, iron(III) complex salts of aminopolycarboxylic acids represented by iron(III) complex salt of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid is usually in a range from 5.5 to 8. For the purpose of rapid processing, it is possible to process at a pH lower than the above described range.

As fixing agents which can be employed in the fixing solution or bleach-fixing solution, thiosulfates, thiocyanate, thioether compounds, thioureas, a large amount of iodide, etc. are exemplified. Of these compounds, thiosulfates are generally employed. Particularly, ammonium thiosulfate is most widely employed. It is preferred to use sulfites, bisulfites or carbonylbisulfite adducts as preservatives in the bleach-fixing solution.

After a desilvering step, the silver halide color photographic material according to the present invention is generally subjected to a water washing step and/or a stabilizing step.

An amount of water required for the water washing step may be set in a wide range depending on characteristics of the photographic light-sensitive materials (due to elements used therein, for example, couplers, etc.), uses thereof, the temperature of the washing water, the number of water washing tanks (stages), the replenishment system such as countercurrent or orderly current, etc. or other various conditions. The relationship between the number of water washing tanks and the amount of water in a multistage countercurrent system can be determined based on the method as described in *Journal of the Society of Motion Picture and Television Engineers*, Vol. 64, pages 248 to 253 (May, 1955).

According to the multi-stage countercurrent system described in the above literature, the amount of water for washing can be significantly reduced. However, increase in staying time of water in a tank causes propagation of bacteria and some problems such as adhesion of floatage formed on the photographic materials, etc. occur. In the method of processing the silver halide color photographic material according to the present invention, a method for reducing amounts of calcium ions and magnesium ions as described in JP-A-62-288838 can be particularly effectively employed in order to solve such problems. Further, sterilizers, for example, isothiazolone compounds as described in JP-A-57-8542, thiabendazoles, chlorine type sterilizers such as sodium chloroisocyanurate, etc., benzotriazoles, sterilizers as described in Hiroshi Horiguchi, Bokin-Bobai No Kaqaku, Biseibutsu No Mekkin-, Sakkin-, Bobai-Gijutsu, edited by Eiseigijutsu Kai, Bokin-Bobaizai Jiten, edited by Nippon Bokin-Bobai Gakkai, etc. can be employed.

The pH of the washing water used in the processing of the photographic light-sensitive materials according to the present invention is usually from 4 to 9, preferably from 5 to 8. The temperature of the washing water and the time for the water washing step can be variously set depending on characteristics or uses of photographic light-sensitive materials, etc. However, it is general to select a range of from 15° C. to 45° C. and a period of from 20 sec. to 10 min. and preferably a range of from 25° C. to 40° C. and a period of from 30 sec. to 5 min.

The photographic light-sensitive material according to the present invention can also be directly processed with a stabilizing solution in place of the above-described water washing step. In such a stabilizing process, any of known methods as described, for example, in JP-A-57-8543, JP-A-58-14834 and JP-A-60-220345 can be employed. To such a stabilizing bath, various chelating agents and antimold agents may also be added.

Overflow solutions resulting from replenishment for the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds as described in U.S. Pat. No. 3,342,597, Schiff's base type compounds as described in U.S. Pat. No. 3,342,599, *Research Disclosure,* No. 14850 and ibid., No. 15159, aldol compounds as described in *Research Disclosure,* No. 13924, metal salt complexes as described in U.S. Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development. Typical examples of the compounds include those as described, for example, in JP-A-56-64339, JP-A-57-144547, and JP-A-58-115438.

In the present invention, various kinds of processing solutions can be employed in a temperature range of from 10° C. to 50° C. Although a standard temperature is from 33° C. to 38° C., it is possible to carry out the processing at higher temperatures in order to accelerate the processing whereby the processing time is shortened, or at lower temperatures in order to achieve improvement in image quality and to maintain stability of the processing solutions.

Further, for the purpose of saving the amount of silver employed in the color photographic light-sensitive material, the photographic processing may be conducted utilizing color intensification using cobalt or hydrogen peroxide as described in West German Patent No. 2,226,770 or U.S. Pat. No. 3,674,499.

It is preferred that the amount of the replenisher is small in each processing step. Preferably the amount of the replenisher is from 0.1 to 50 times, more preferably from 3 to 30 times the amount of the solution carried over from the preceding bath per unit area of the photographic light-sensitive material.

In order to develop black-and-white photographic light-sensitive materials, various known developing agents can be employed in the present invention. For instance, polyhydroxybenzenes, for example, hydroquinone, 2-chlorohydroquinone, 2-methylhydroquinone, catechol, and pyrogallol; aminophenols, for example, p-aminophenol, N-methyl-p-aminophenol, and 2,4-diaminophenol; 3-pyrazolidones, for example, 1-phenyl-3-pyrazolidone, 1-phenyl-4,4'-dimethyl-3-pyrazolidone, 1-phenyl-4-methyl-4-hydroxymethyl-3-pyrazolidone, and 5,5-dimethyl-1-phenyl-3-pyrazolidone; and ascorbic acids; are employed individually or in a combination. Further, a developing solution as described in JP-A-58-55928 may be employed.

Specific examples and methods for use of developing agents, preservatives, buffering agents and methods of development with respect to black-and-white photographic light-sensitive materials are described, for example, in *Research Disclosure,* No. 17643 (December, 1978), Items XIX to XXI.

In the case of using DRR compounds, any silver halide developing agent (or electron donor) which is capable of cross-oxidation of the DRR compounds may be employed in the present invention.

These developing agents may be incorporated into an alkaline developing solution (processing element) or in an appropriate layer of the photographic element. Examples of developing agents suitable for use in the present invention are illustrated below: hydroquinone, aminophenols (for example, N-methylaminophenol), 1-phenyl-3-pyrazolidinone, 1-phenyl 4,4-dimethyl-3-pyrazolidinone, 1-phenyl-4-methyl-4-hydroxymethyl-3-pyrazolidinone, N,N-diethyl-p-phenylenediamine, 3-methyl-N,N-diethyl-p-phenylenediamine, and 3-methoxy-N-ethoxy-p-phenylenediamine.

Of these, black-and-white developing agents capable of reducing stains of an image-receiving layer (mordant layer) are generally particularly preferable just as described above with respect to the alkaline development processing solution.

In applying the photographic light-sensitive material in accordance with the present invention to diffusion transfer process type film units, a viscous developing solution is preferably used. Such a viscous developing solution is a liquid composition containing processing components necessary for developing silver halide emulsions (and forming a diffusion-transferred dye image), in which water is a main solvent, with a hydrophilic solvent such as methanol or methylcellosolve being sometimes present. The processing composition preferably contains a hydrophilic polymer such as high molecular weight polyvinyl alcohol., hydroxyethyl cellulose, and sodium carboxymethylcellulose. These polymers are used so as to impart a viscosity of about 1 poise or more, preferably from about 500 to about 1,000 poises, to the processing composition at room temperature.

The above-described processing composition can be employed preferably by filling it in a pressure-rupturable container as described, for example, in U.S. Pat. Nos, 2,543,181, 2,634,886, 2,653,,732, 2,723,051, 3,056,491, 3,056,492 and 3,152,515.

In accordance with the present invention, the direct positive photographic light-sensitive materials which provide both a high maximum density and a low minimum density can be obtained. Further, these superior effects can be still exhibited even when the photographic light-sensitive materials are preserved under high temperature and high humidity conditions. Therefore, the direct positive photographic light-sensitive materials according to the present invention are particularly suitable for practical use.

The present invention is now illustrated in greater detail with reference to the following examples, but the present invention is not to be construed as being limited thereto.

Unless otherwise indicated, all percents, ratios, parts, etc. are by weight.

EXAMPLE 1

The following First layer to Fourteenth layer were coated on the front side of a paper support (having a thickness of 100 μm), both surfaces of which were laminated with polyethylene, and the following Fifteenth layer to Sixteenth layer were coated on the back side of the paper support to prepare a color photographic light sensitive material. The polyethylene laminated on the First layer side of the support contained titanium dioxide as a white pigment and a small amount of ultramarine as a bluish dye.

Construction of Layers

The composition of each layer is shown below. The coating amounts of the components are described in the unit of g/m$^2$. With respect to silver halide, the coating amount is indicated in terms of a silver coating amount. The emulsion used in each layer was prepared according to the method for preparation of Emulsion EM-1 described below. The emulsion used in the Fourteenth layer was a Lippmann emulsion not being chemically sensitized on the surfaces of the grains.

| | |
|---|---|
| First Layer: Antihalation Layer | |
| Black colloidal silver | 0.10 |
| Gelatin | 1.30 |
| Second Layer: Intermediate Layer | |
| Gelatin | 0.70 |
| Third Layer: Low-Sensitive Red-Sensitive Layer | |
| Silver bromide emulsion spectrally sensitized with red-sensitizing dyes (ExS-1, 2, 3) (average grain size: 0.3 μm, size distribution (coefficient of variation): 8%, octahedral) | 0.06 |
| Silver chlorobromide emulsion spectrally sensitized with red-sensitizing dyes (ExS-1, 2, 3) (silver chloride: 5 mol %, average grain size: 0.45 μm, size distribution: 10%, octahedral) | 0.10 |
| Gelatin | 1.00 |
| Cyan coupler (ExC-1) | 0.11 |
| Cyan coupler (ExC-2) | 0.10 |
| Color fading preventing agent (Cpd-2, 3, 4, 13, mixing ratio: 1/1/1/1) | 0.12 |
| Coupler dispersing medium (Cpd-5) | 0.03 |
| Coupler solvent (Solv-7, 2, 3, mixing ratio: 1/1/1) | 0.06 |
| Fourth Layer: High-Sensitive Red-Sensitive Layer | |
| Silver bromide emulsion spectrally sensitized with red-sensitizing dyes (ExS-1, 2, 3) (average grain size: 0.60 μm, size distribution: 15%, octahedral) | 0.14 |
| Gelatin | 1.00 |
| Cyan coupler (ExC-1) | 0.15 |
| Cyan coupler (ExC-2) | 0.15 |
| Color fading preventing agent (Cpd-2, 3, 4, 13, mixing ratio: 1/1/1/1) | 0.15 |
| Coupler dispersing medium (Cpd-5) | 0.03 |
| Coupler solvent (Solv-7, 2, 3, mixing ratio: 1/1/1) | 0.10 |
| Fifth Layer: Intermediate Layer | |
| Gelatin | 1.00 |
| Color mixing preventing agent (Cpd-7) | 0.08 |
| Color mixing preventing agent solvent (Solv-4, 5, mixing ratio: 1/1) | 0.16 |
| Polymer latex (Cpd-8) | 0.10 |
| Six Layer: Low-Sensitive Green-Sensitive Layer | |
| Silver bromide emulsion spectrally sensitized with green-sensitizing dye (ExS-3) (average grain size: 0.25 μm, size distribution: 8%, octahedral) | 0.04 |
| Silver bromide emulsion spectrally sensitized with green-sensitizing dye (ExS-3, 4) (average grain size: 0.45 μm, size distribution: 11%, octahedral) | 0.06 |
| Gelatin | 0.80 |
| Magenta coupler (ExM-1,2, mixing ratio: 1/1) | 0.11 |
| Color fading preventing agent (Cpd-9) | 0.10 |
| Stain preventing agent (Cpd-10, 22, mixing ratio: 1/1) | 0.014 |
| Stain preventing agent (Cpd-23) | 0.001 |
| Stain preventing agent (Cpd-12) | 0.01 |
| Coupler dispersing medium (Cpd-5) | 0.05 |
| Coupler solvent (Solv-4, 6, mixing ratio: 1/1) | 0.15 |
| Seventh Layer: High-Sensitive Green-Sensitive Layer | |
| Silver bromide emulsion spectrally sensitized with green-sensitizing dyes (ExS-3, 4) (average grain size: 0.8 μm, size distribution: 16%, octahedral) | 0.10 |
| Gelatin | 0.80 |
| Magenta coupler (ExM-1, 2, mixing ratio: 1/1) | 0.11 |
| Color fading preventing agent (Cpd-9) | 0.10 |
| Stain preventing agent (Cpd-10, 22, mixing ratio: 1/1) | 0.013 |
| Stain preventing agent (Cpd-23) | 0.001 |
| Stain preventing agent (Cpd-12) | 0.01 |

-continued

| | |
|---|---|
| Coupler dispersing medium (Cpd-5) | 0.05 |
| Coupler solvent (Solv-4, 6, mixing ratio: 1/1) | 0.15 |
| Eighth Layer: Intermediate Layer | |
| Same as Fifth Layer | |
| Ninth Layer: Yellow Filter Layer | |
| Yellow colloidal silver | 0.20 |
| Gelatin | 1.00 |
| Color mixing preventing agent (Cpd-7) | 0.06 |
| Color mixing preventing agent solvent (Solv-4, 5, mixing ratio: 1/1) | 0.15 |
| Polymer latex (Cpd-8) | 0.10 |
| Tenth Layer: Intermediate Layer | |
| Same as Fifth Layer | |
| Eleventh Layer: Low-Sensitive Blue-Sensitive Layer | |
| Silver bromide emulsion spectrally sensitized with blue-sensitizing dyes (ExS-5, 6) (average grain size: 0.45 μm, size distribution: 8%, octahedral) | 0.07 |
| Silver bromide emulsion spectrally sensitized with blue-sensitizing dyes (ExS-5, 6) (average grain size: 0.60 μm, size distribution: 14%, octahedral) | 0.10 |
| Gelatin | 0.50 |
| Yellow coupler (ExY-1) | 0.22 |
| Stain preventing agent (Cpd-11) | 0.001 |
| Color fading preventing agent (Cpd-6) | 0.10 |
| Coupler dispersing medium (Cpd-5) | 0.05 |
| Coupler solvent (Solv-2) | 0.05 |
| Twelfth Layer: High-Sensitive Blue-Sensitive Layer | |
| Silver bromide emulsion spectrally sensitized with blue-sensitizing dyes (ExS-5, 6) (average grain size: 1.2 μm, size distribution: 21%, octahedral) | 0.25 |
| Gelatin | 1.00 |
| Yellow coupler (ExY-1) | 0.41 |
| Stain preventing agent (Cpd-11) | 0.002 |
| Color fading preventing agent (Cpd-6) | 0.10 |
| Coupler dispersing medium (Cpd-5) | 0.05 |
| Coupler solvent (Solv-2) | 0.10 |
| Thirteenth Layer: Ultraviolet Light Absorbing Layer | |
| Gelatin | 1.50 |
| Ultraviolet light absorbing agent (Cpd-1, 3, 13, mixing ratio: 1/1/1) | 1.00 |
| Color mixing preventing agent (Cpd-6, 14, mixing ratio: 1/1) | 0.06 |
| Dispersing medium (Cpd-5) | 0.05 |
| Ultraviolet light absorbing agent solvent (Solv-1, 2, mixing ratio: 1/1) | 0.15 |
| Irradiation preventing dye (Cpd-15, 16, mixing ratio: 1/1) | 0.02 |
| Irradiation preventing dye (Cpd-17, 18, mixing ratio: 1/1) | 0.02 |
| Fourteenth Layer: Protective Layer | |
| Silver chlorobromide fine particles (silver chloride: 97 mol %, average grain size: 0.2 μm) | 0.05 |
| Acryl-modified copolymer of polyvinyl-alcohol (degree of modification: 17%) | 0.02 |
| Polymethyl methacrylate particles (average particle size: 2.4 μm) and silicon oxide (average particle size: 5 μm), (mixing ratio: 1/1) | 0.05 |
| Gelatin | 1.50 |
| Gelatin hardener (H-1) | 0.17 |
| Fifteenth Layer: Back Layer | |
| Gelatin | 2.50 |
| Sixteenth Layer: Back Protective Layer | |
| Polymethyl methacrylate particles (average particle size: 2.4 μm) and silicon oxide (average particle size: 5 μm), (mixing ratio: 1/1) | 0.05 |
| Gelatin | 2.00 |
| Gelatin hardener (H-1) | 0.11 |

Preparation of Emulsion EM-1

An aqueous solution of potassium bromide and an aqueous solution of silver nitrate were added simultaneously to an aqueous gelatin solution at 75° C. over a period of 15 minutes while vigorously stirring, to obtain an octahedral silver bromide emulsion having an average grain diameter of 0.40 μm. 0.1 g of 3,4-dimethyl-1,3-thiazoline-2-thione, 4 mg of sodium thiosulfate and 7 mg of chloroauric acid (tetrahydrate) were added to the emulsion per mol of silver in order and the emulsion was heated to 75° C. for 25 minutes to be chemically sensitzed. The thus-prepared silver bromide grains were used as cores and were further grown under the same precipitation conditions as above to obtain finally a monodispersed octahedral core/shell type silver bromide emulsion having an average grain diameter of 0.58 μm. The coefficient of variation of the grain size was about 10%.

1.5 mg of sodium thiosulfate and 1.0 mg of chloroauric acid (tetrahydrate) were added to the emulsion per mol of silver, and the emulsion was heated to 60° C. for 45 minutes to be chemically sensitized, Thus an internal latent image type silver halide emulsion was obtained.

To each light-sensitive layer, a nucleating agent and a nucleation accelerating agent were added as shown in Table 1 below.

Also, to each layer, as emulsifiying dispersing aids, Alkanol XC (manufactured by Du Pont) and sodium alkylbenzenesulfonate, and as coating aids, succinic acid ester and Megafac F-120 (manufactured by Dai Nipon Ink and Chemical Co, Ltd.) were added. Furthermore, to the layers containing silver halide or colloidal silver, Stabilizers (Cpd-19, 20, 21) were added. Thus, color printing paper which were designated Sample Nos. 1 to 12 were prepared.

The compounds used in this example are illustrated below.

ExS-1

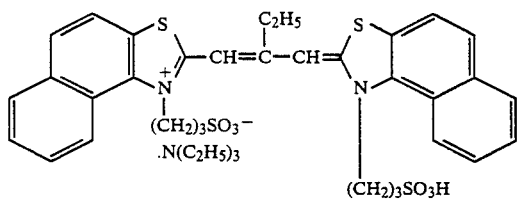

ExS-2

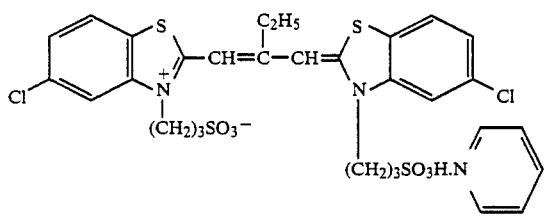

ExS-3

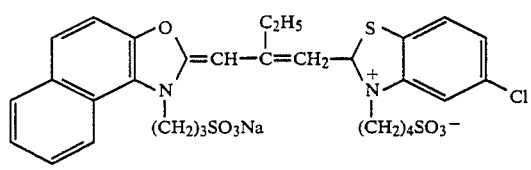

ExS-4

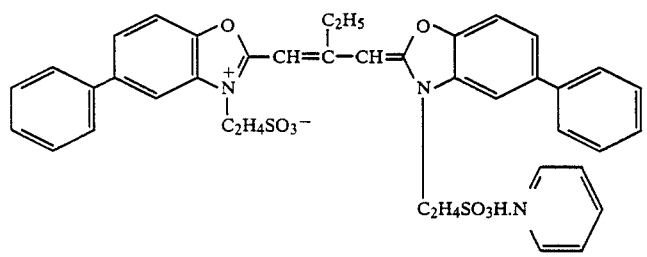

ExS-5

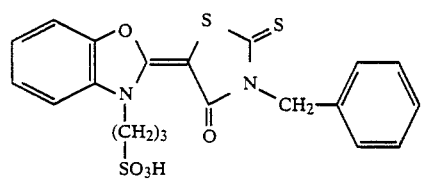

-continued
ExS-6
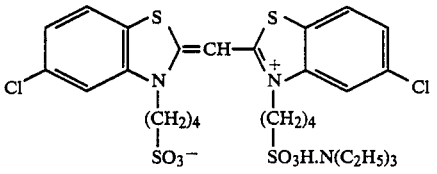
Cpd-1
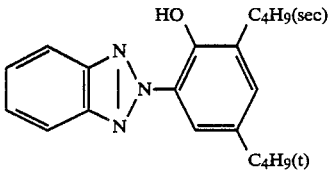
Cpd-2
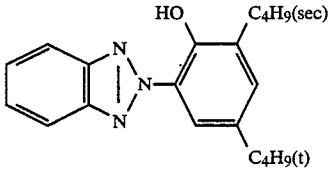
Cpd-3
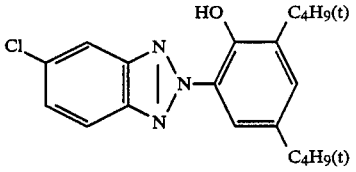
Cpd-4
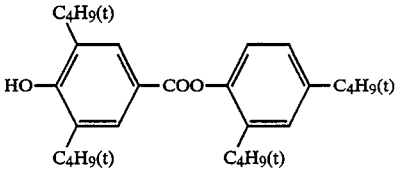
Cpd-5
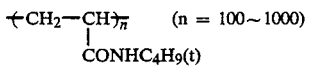
Cpd-6
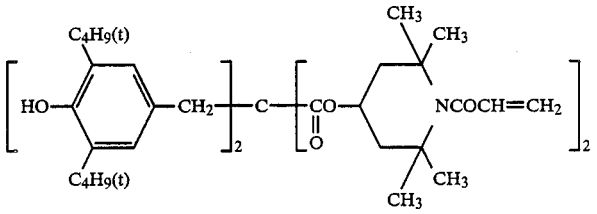
Cpd-7
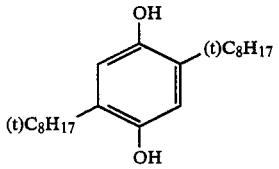
Polyethylacrylate Cpd-8

-continued
Cpd-9
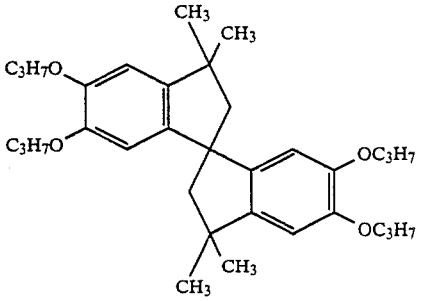
Cpd-10
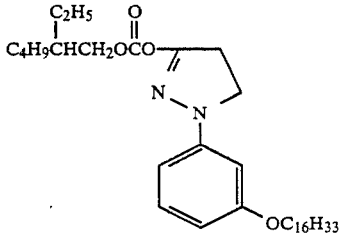
Cpd-11
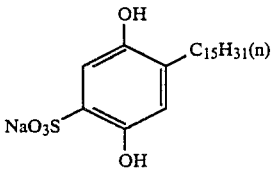
Cpd-12
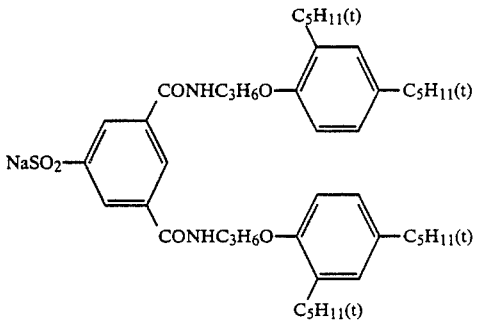
Cpd-13
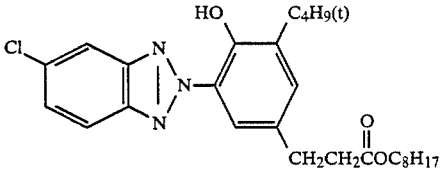
Cpd-14
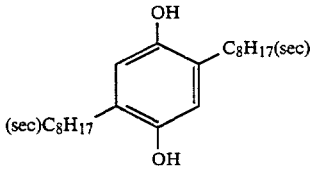
Cpd-15
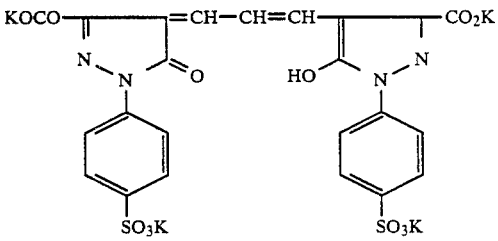

-continued
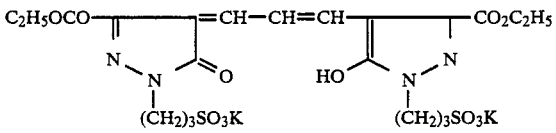
Cpd-16
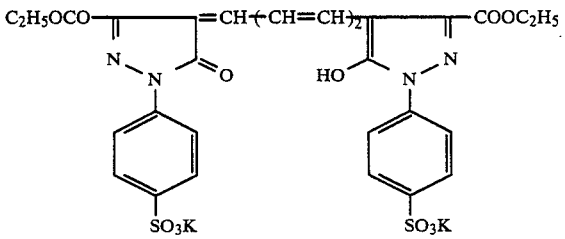
Cpd-17
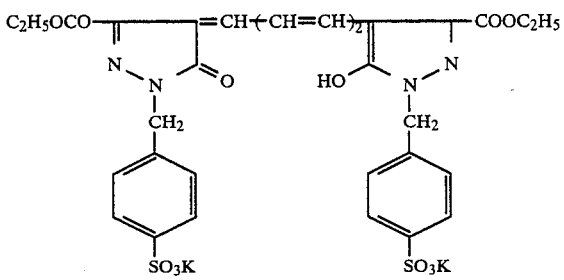
Cpd-18
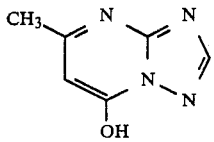
Cpd-19
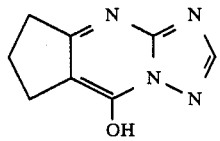
Cpd-20
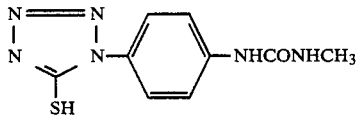
Cpd-21
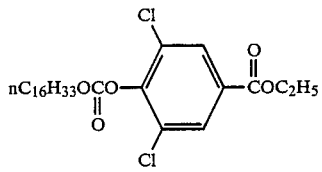
Cpd-22
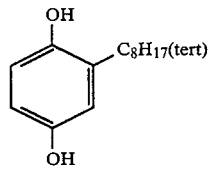
Cpd-23
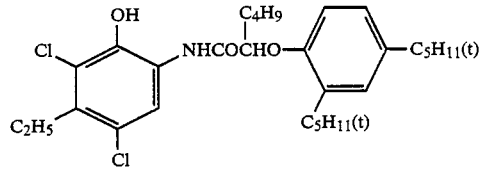
ExC-1

-continued

ExC-2

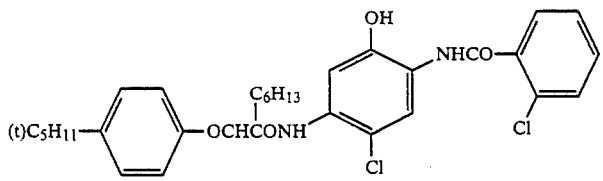

ExM-1

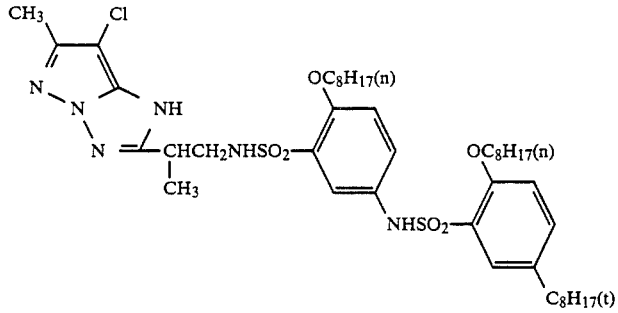

ExM-2

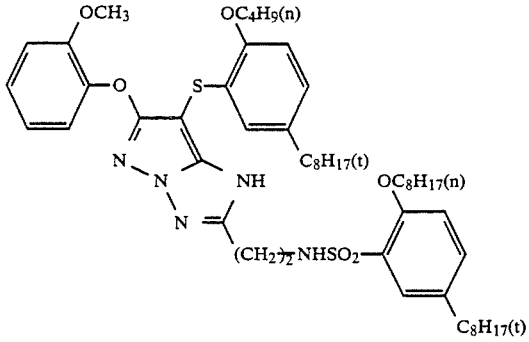

ExY-1

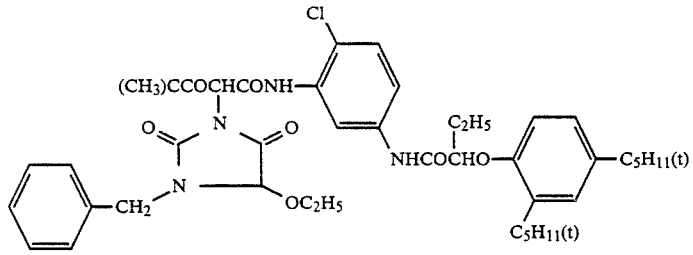

Solv-1 Di(2-ethylhexyl) phthalate
Solv-2 Trinonyl phosphate
Solv-3 Di(3-methylhexyl) phthalate
Solv-4 Tricresyl phosphate
Solv-5 Dibutyl phathalate
Solv-6 Trioctyl phosphate
Solv-7 Di(2-ethylhexyl) sebacate
H-1 1,2-Bis(vinylsulfonylacetamido)ethane The thus-prepared color printing papers, Sample Nos. 1 to 12 were exposed to grey light so as to achieve a development rate of 50%, and then subjected to running processing according to Processing Method A described below using an automatic developing machine with a color developing tank of 8 liters, a bleach fixing tank of 4 liters, washing with water tanks (1) and (2) of 4 liters respectively, and washing with water tank (3) of 0.5 liter in the total amount of 30 $m^2$, respectively.

Each of the above described color printing papers, Sample Nos. 1 to 12, was subjected to wedge-exposure (0.1 second, 10 CMS, using a halogen lamp at 3200°K) and then to development processing according to Processing Method A using the processing solutions after the above described running processing.

Processing Method A:

| Processing Step | Time | Temperature (°C.) | Amount of Replenishment ($ml/m^2$) |
|---|---|---|---|
| Color Development | 1 min. 10 sec | 37 | 300 |
| Bleach-Fixing | 40 sec | 35 | 300 |
| Washing with Water (1) | 40 sec | 30 to 36 | |
| Washing with Water (2) | 40 sec | 30 to 36 | |
| Washing with Water (3) | 15 sec | | 320 |
| Drying | 30 sec | 75 to 80 | |

The replenishment of washing water was conducted using a so-called countercurrent system, wherein a replenisher was supplied to the water washing bath (3), the solution that overflowed from the water washing bath (3) was introduced into the water washing bath (2), and the solution that overflowed from the water washing bath (2) was introduced into the water washing bath (1). The amount of the processing solution carried over from the preceding bath together with the photographic material being processed was 35 ml/m$^2$ and thus the replenishment magnification to washing with water was 9.1 times.

The compositions of the processing solutions used were as follows.

Color developing solution

| | Tank Solution | Replenisher |
|---|---|---|
| Ethylenediaminetetrakis-methylenephosphonic acid | 0.5 g | 0.5 g |
| Diethylene glycol | 8.0 g | 13.0 g |
| Benzyl alcohol | 12.0 g | 18.5 g |
| Sodium bromide | 0.6 g | — |
| Sodium chloride | 0.5 g | — |
| Sodium sulfite | 2.0 g | 2.5 g |
| N,N-Diethylhydroxylamine | 3.5 g | 4.5 g |
| Triethylenediamine (1,4-diazabicyclo[2,2,2]octane | 3.5 g | 4.5 g |
| 3-Methyl-4-amino-N-ethyl N-(β-methanesulfonamidoethyl)-aniline sulfate | 5.5 g | 8.0 g |
| Potassium carbonate | 30.0 g | 30.0 g |
| Fluorescent whitening agent (stilbene type) | 1.0 g | 1.3 g |
| Pure water to make | 1,000 ml | 1,000 ml |
| pH | 10.50 | 10.90 |

pH was adjusted with potassium hydroxide or hydrochloric acid.

Bleach-Fixing solution

| | (Both Tank Solution and Replenisher) |
|---|---|
| Ammonium thiosulfate | 100 g |
| Sodium hydrogensulfite | 21.0 g |
| Ammonium iron(III) ethylenediaminetetraacetate dihydrate | 50.0 g |
| Disodium ethylenediaminetetraacetate dihydrate | 5.0 g |
| Ammonium bromide | 45 g |
| Pure water to make | 1,000 ml |
| pH | 6.3 |

pH was adjusted with aqueous ammonia or hydrochloric acid.

Washing Water

Pure water was used (both Tank Solution and Replenisher).

The pure water used herein was prepared by conducting ion exchange treatment on city water to reduce the total cation concentration other than hydrogen ion and the total anion concentration other than hydroxy ions to a level of not more than 1 ppm.

With the samples thus processed, the density of the magenta color image obtained was measured. The results are shown in Table 1 below.

TABLE 1

| Sample No. | Nucleating Agent | Nucleating Accelerating Agent | Dmax | Dmin |
|---|---|---|---|---|
| 1 | N-I-8 | A-7 | 2.4 | 0.10 |
| 2 | N-I-9 | " | 2.4 | 0.10 |
| 3 | N-I-10 | " | 2.4 | 0.10 |
| 4 | N-I-25 | " | 2.4 | 0.10 |
| 5 | N-I-23 | " | 2.4 | 0.10 |

TABLE 1-continued

| Sample No. | Nucleating Agent | Nucleating Accelerating Agent | Dmax | Dmin |
|---|---|---|---|---|
| 6 | Comparison A | " | 2.1 | 0.12 |
| 7 | N-I-8 | — | 2.1 | 0.12 |
| 8 | N-I-9 | — | 2.1 | 0.12 |
| 9 | N-I-10 | — | 2.1 | 0.12 |
| 10 | N-I-25 | — | 2.1 | 0.12 |
| 11 | N-I-23 | — | 2.1 | 0.12 |
| 12 | Comparison A | " | 1.8 | 0.14 |

Amount added:

Nucleating agent: $1.9\times10^{-6}$ mol per mol of silver

Nucleating accelerating agent:

$4.5\times10^{-4}$ mol per mol of silver

Comparison A

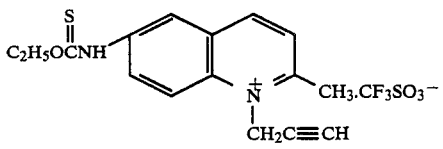

As is apparent from the results shown in Table 1, Sample Nos. 1 to 5 containing the nucleating agent and the nucleating accelerating agent, respectively, according to the present invention are preferred in view of high $D_{max}$ and low $D_{min}$ in comparison with Comparative Sample Nos. 6 to 12. Almost the same results were obtained with respect to densities of cyan and yellow color images.

EXAMPLE 2

The same procedure as described in Example 1 was repeated but using each of nucleating accelerating agents A-2, A-3, A-4, A-5, A-9, A-12, A-19, A-24 and A-27 in place of nucleating accelerating agent A-7. Almost the same results as those described in Example 1 were obtained.

EXAMPLE 3

Color printing paper was prepared in the same manner as described in Example 1 but using a nucleating agent and a nucleating accelerating agent as shown in Table 2 below.

The color printing papers, Sample Nos. 1 to 14, were preserved under the conditions of 45° C. and 80% RH for 3 days, then subjected to wedge-exposure and development processing according to Processing Method B described below.

Processing Method B:

| Processing Step | Time (sec) | Temperature (°C.) |
|---|---|---|
| Color Development | 60 | 38 |
| Bleach-Fixing | 30 | 38 |
| Washing with Water (1) | 30 | 38 |
| Washing with Water (2) | 30 | 38 |

The composition of the processing solutions used were as follows:

Color Developing solution

| | Tank Solution |
|---|---|
| Diethylenetriaminepentaacetic acid | 0.5 g |
| 1-Hydroxyethylidene-1,1-disulfonic acid | 0.5 g |
| Diethylene glycol | 8.0 g |
| Benzyl alcohol | 9.0 g |
| Sodium bromide | 0.7 g |
| Sodium chloride | 0.5 g |
| Sodium sulfite | 2.0 g |
| Hydroxylamine sulfate | 2.8 g |
| 3-Methyl-4-amino-N-ethyl-N-(β-methanesulfonamidoethyl) aniline sulfate | 2.0 g |
| 3-Methyl-4-amino-N-ethyl-N-(β-hydroxyethyl) aniline sulfate | 4.0 g |
| Potassium carbonate | 30.0 g |
| Fluorescent whitening agent (stilbene type) | 1.0 g |
| Pure water to make | 1,000 ml |
| pH | 10.50 |

pH was adjusted with potassium hydroxide or hydrochloric acid.

Bleach-Fixing Solution

| | Tank Solution |
|---|---|
| Ammonium thiosulfate | 77.0 g |
| Sodium hydrogensulfite | 14.0 g |
| Ammonium iron (III) ethylenediaminetetraacetate dihydrate | 40.0 g |
| Disodium ethylenediaminetetraacetate dihydrate | 4.0 g |
| Ammonium bromide | 45 g |
| 2-Mercapto-1,3,4-triazole | 0.5 g |
| Pure water to make | 1,000 ml |
| pH | 7.0 |

pH was adjusted with aqueous ammonia or hydrochloric acid.

Washing Water

Pure water was used (both Tank Solution and Replenisher).

With the sample thus-processed, the density of cyan color image obtained was measured. The results are shown in Table 2 below.

TABLE 2

| Sample No. | Nucleating Agent | Nucleating Accelerating Agent | Before Incubation Dmax | Before Incubation Dmin | After Incubation Dmax | After Incubation Dmin |
|---|---|---|---|---|---|---|
| 1 | N-I-16 | A-7 | 2.4 | 0.10 | 2.4 | 0.10 |
| 2 | N-I-17 | " | 2.4 | 0.10 | 2.4 | 0.10 |
| 3 | N-I-14 | " | 2.4 | 0.10 | 2.4 | 0.10 |
| 4 | N-I-25 | " | 2.4 | 0.10 | 2.4 | 0.10 |
| 5 | N-I-2 | " | 2.4 | 0.10 | 2.4 | 0.10 |
| 6 | N-I-3 | " | 2.4 | 0.10 | 2.4 | 0.10 |
| 7 | Comparison A | " | 2.2 | 0.11 | 2.1 | 0.12 |
| 8 | N-I-16 | — | 2.1 | 0.12 | 1.8 | 0.13 |
| 9 | N-I-17 | — | 2.1 | 0.12 | 1.9 | 0.13 |
| 10 | N-I-14 | — | 2.1 | 0.12 | 1.8 | 0.13 |
| 11 | N-I-25 | — | 2.1 | 0.12 | 1.9 | 0.13 |
| 12 | N-I-2 | — | 2.1 | 0.12 | 1.9 | 0.13 |
| 13 | N-I-3 | — | 2.1 | 0.12 | 1.9 | 0.13 |
| 14 | Comparison A | — | 1.9 | 0.13 | 1.3 | 0.15 |

Amount Added:

Nucleating agent:

N-I-2 and N-I-3 were $1.6\times10^{-5}$ mol per mol of silver and the others were $2.8\times10^{-6}$ mol per mol of silver, respectively.

Nucleating Accelerating agent:

$2.8\times10^{-4}$ mol per mol of silver

As is apparent from the results shown in Table 2, Sample Nos. 1 to 6 containing the nucleating agent and the nucleating accelerating agent, respectively, according to the present invention are preferred because of less decrease in $D_{max}$ and less increase in $D_{min}$ due to inCubation as compared with Comparative Sample Nos. 7 to 14. Almost the same results were obtained with respect to densites of magenta and yellow color images.

EXAMPLE 4

The same procedure as described in Example 3 was repeated but using each of nucleating accelerating agents A-4, A-5, A-11, A-20, A-25, and A-30 in place of nucleating accelerating agent A-7. Almost the same results as those described in Example 3 were obtained.

EXAMPLE 5

Preparation of Emulsion EM-2

An aqueous mixture solution containing potassium bromide and sodium chloride and an aqueous solution of silver nitrate were simultaneously added at 65° C. over a period of about 30 minutes with vigorous stirring to an aqueous gelatin solution containing 0.3 g of 3,4-dimethyl-1,3-thiazoline-2-thione per mol of Ag to obtain a monodispersed silver chlorobromide emulsion (silver bromide content: 30 mol%) having an average grain diameter of about 0.23 μm. 25 mg of sodium thiosulfate and 15 mg of chloroauric acid (tetrahydrate) were added to the emulsion per mol of silver and the emulsion was heated at 65° C. for 25 minutes to be chemically sensitized. The thus prepared silver chlorobromide grains were used as cores and were treated under the same precipitation conditions as those for the first time to be further grown thereby producing finally a monodispersed core/shell silver chlorobromide emulsion (silver bromide content: 25 mol%) having an average grain diameter of about 0.65 μm. A coefficient of variation on grain size was about 12%. To the emulsion were added 1.5 mg of sodium thiosulfate and 1.5 mg of chloroauric acid (tetrahydrate) per mol of silver, and the emulsion was heated at 60° C. for 70 minutes to be chemically sensitized thereby producing an internal latent image type silver halide emulsion EM-2.

The same procedure as described in Example 1 was repeated except using Emulsion EM-2 or an emulsion prepared in a similar manner thereto in place of Emulsion EM-1. Almost the same results as those described in Example 1 were obtained.

EXAMPLE 6

The same procedure as described in Example 1 was repeated but changing the magenta coupler to the one shown below. Almost the same results as those described in Example 1 were obtained.

Magenta Coupler:

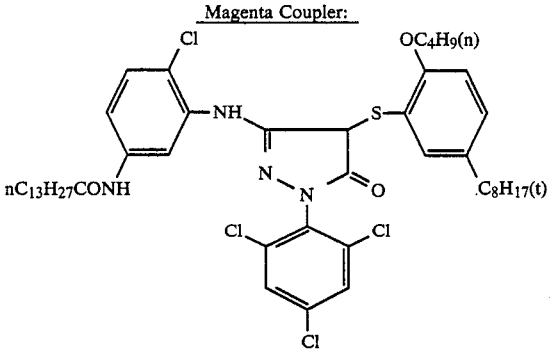

EXAMPLE 7

Preparation of Emulsion X

An aqueous solution of silver nitrate and an aqueous solution of potassium bromide were simultaneously added at a constant addition rate to an aqueous gelatin solution (pH: 5.5) at 75° C. containing 20 mg per liter of thioether (1,8-dihydroxy-3,6-dithiaoctane) under thoroughly stirring while maintaining a silver electrode potential constantly at a rate of addition so that an amount of silver nitrate corresponding to ⅛ mol was added for 5 minutes to obtain a spherical monodispersed silver bromide emulsion having an average grain diameter of about 0.14 μm. 20 mg of sodium thiosulfate and 20 mg of chloroauric acid (4 hydrate) were added to the emulsion per mol of silver halide and the pH was adjusted to 7.5, followed by heating at.75° C. for 80 minutes with thoroughly stirring to effect chemical sensitization. The thus-obtained silver bromide grains were used as cores, and an aqueous solution of silver nitrate (containing 7/8 mols of silver nitrate) and an aqueous solution of potassium bromide were added simultaneously under thoroughly stirring at the same temperature as above over a period of 40 minutes while maintaining a silver electrode potential for growing regular octahedral grains in order to allow for the growth of a shell thereby to obtain a cubic monodispersed core/-shell type silver bromide emulsion having an average grain diameter of about 0.3 μm. The pH of the emulsion was adjusted to 6.5 and 5 mg of sodium thiosulfate and 5 mg of chloroauric acid (4 hydrate) were added thereto per mol of silver halide, followed by ripening at 75° C. for 60 minutes to effect chemical sensitization of the surface of the shell to finally obtain an internal image type octahedral monodispersed core/shell silver bromide emulsion (Emulsion X). As a result of measurement on grain size distribution of the emulsion using electron microscopic photographs, it was found that the average grain diameter was 0.30 μm and the coefficient of variation (percent of a value obtained by dividing a statistical standard deviation with the above-described average grain diameter) was 10%.

To Emulsion X described above was added, as a panchromatic sensitizing dye, 5 mg of 3,3'-diethyl-9-methylthiacarbocyanine per mol of silver halide, and then were added $1.4\times10^{-5}$ mol of the nucleating agent and $2.5\times10^{-4}$ mol of the nucleating accelerating agent as shown in Table 3 below per mol of silver halide, respectively. The coating solution thus-prepared was coated on a polyethylene terephthalate film support so as to give a silver coating amount of 2.8 g/m$^2$ simultaneously with a protective layer composed of gelatin and a hardening agent. Thus, direct positive photographic light-sensitive material Samples No. 1 to 6 each being sensitive to red light were prepared.

These samples were exposed through a step wedge using a sensitometer equipped with a tungsten lamp of 1 KW (color temperature: 2,854°K) for 0.1 second. Thereafter, each sample was developed at 38° C. for 16 seconds by an automatic developing machine (Kodak Proster I Processor) using Kodak Proster Plus processing solution (developing solution: pH of 10.7), followed by washing with water, fixing and washing with water steps by the same processor and dried. The maximum density ($D_{max}$) and the minimum density ($D_{min}$) of direct positive image thus-formed in each sample were measured. The results are shown in Table 3 below.

TABLE 3

| Sample No. | Nucleating Agent | Nucleating Accelerating Agent | Dmax | Dmin |
|---|---|---|---|---|
| 1 | N-I-15 | A-2 | 2.45 | 0.07 |
| 2 | N-I-25 | " | 2.46 | 0.07 |
| 3 | Comparison A | " | 2.20 | 0.08 |
| 4 | N-I-15 | — | 2.16 | 0.10 |
| 5 | N-I-25 | — | 2.17 | 0.10 |
| 6 | Comparison A | — | 2.05 | 0.11 |

As is apparent from the results shown in Table 3, Sample Nos. 1 to 2 containing the nucleating agent and the nucleation acclerating agent according to the present invention are preferred in view of high $D_{max}$ and low $D_{min}$ as compared with Comparative Sample Nos. 3 to 6.

EXAMPLE 8

Preparation of Core/shell Type Direct Positive Emulsion P

An aqueous solution of potassium bromide and an aqueous solution of silver nitrate were simultaneously added at 75° C. over a period of about 60 minutes with vigorous stirring to an aqueous gelatin solution to obtain a silver bromide emulsion. Before the precipitation, 100 mg of 3,4-dimethyl-1,3-thiazoline-2-thione per mole of silver and 5 g of benzimidazole per mol of silver were added to the precipitation vessel. After completion of the precipitation, silver bromide crystals having an average grain diameter of about 1.1 μm were formed. Then 5.4 mg of sodium thiosulfate per mol of silver and 3.9 mg of potassium chloroaurate per mol of silver were added to the silver bromide emulsion and the emulsion was heated at 75° C. for 80 minutes to be chemically sensitized. The thus chemically sensitized silver bromide grains were used as cores and to the emulsion were added simultaneously an aqueous solution of potassium bromide and an aqueous solution of silver nitrate over a period of 40 minutes in the same manner as in the first step described above to prepare a core/shell emulsion. The final average grain diameter of the emulsion was 1.5 μm.

To the core/shell type emulsion were added 0.32 mg of sodium thiosulfate per mol of silver and 57 mg of poly(N-vinylpyrrolidone) per mol of silver and the emulsion was heated at 60° C. for 60 minutes to be chemically sensitized on the surface of the grains, whereby Emulsion P was prepared.

Preparation of Light-Sensitive Sheet 1

On a transparent film support of polyethylene terephthalate, Layer 1 to Layer 6 were coated according to the layer structure shown below to prepare Light-Sensitive Sheet 1.

Layer 6: Protective layer containing gelatin
Layer 5: Red-sensitive core/shell type direct positive emulsion layer
Layer 4: Layer containing a cyan DRR compound
Layer 3: Light shielding layer
Layer 2: White reflective layer
Layer 1: Mordant layer
Support
Layer 1: Mordant layer containing a copolymer having the repeating unit described below in the ratio described below:

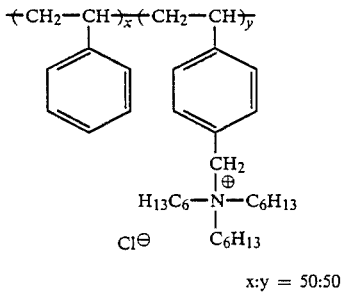

x:y = 50:50 which is described in U.S. Pat. No. 3,898,088 (3.0 g/m$^2$) and gelatin (3.0 g/m$^2$)

Layer 2: White reflective layer containing titanium oxide (20 g/m$^2$) and gelatin (2.0 g/m$^2$)
Layer 3: Light-shielding layer containing carbon black (2.0 g/m$^2$) and gelatin (1.5 g/m$^2$)
Layer 4: Layer containing a cyan DRR compound described below (0.44 g/m$^2$), tricyclohexyl phosphate (0.09 g/m$^2$) and gelatin (0.8 g/m$^2$)

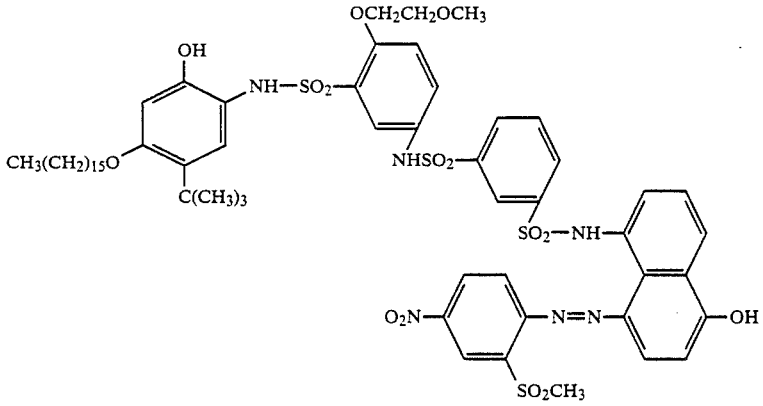

Layer 5: Red-sensitive core/shell type direct positive silver bromide emulsion layer containing Emulsion P described above (0.81 g/m$^2$ as silver), a red-sensitizing dye, the nucleating agent and the nucleating accelerating agent as shown in Table 4 below, 4-hydroxy-6-methyl-1,3,3a,7-tetraazaindene (4.3 mg/m$^2$) and sodium 5-pentadecylhydroquinone-2-sulfonate (0.11 g/m$^2$)
Layer 6: Protective layer containing gelatin (1.0 g/m$^2$)

Further, Light-Sensitive Sheets 2 to 9 were prepared in the same manner as described for Light-Sensitive Sheet 1 above but adding the compounds as shown in Table 4 below to the red-sensitive emulsion layer (Layer 5).

Light-Sensitive Sheets 1 to 9 thus-prepared were preserved under the conditions of 45° C. and 75% RH for 3 days to conduct an enforced storage test (incubation test).

The above-described light-sensitive sheets subjected to the enforced storage test and those not subjected were exposed to light and subjected to development processing in combination with the elements shown below to evaluate photographic properties ($D_{max}$ and $D_{min}$).

Processing Solution:

| | |
|---|---|
| 1-p-Tolyl-4-methyl-4-hydroxymethyl-3-pyrazolidone | 12.0 g |
| Methylhydroquinone | 0.3 g |
| 5-Methylbenzotriazole | 3.5 g |
| Sodium sulfite | 2.0 g |
| Sodium salt of carboxymethyl cellulose | 58 g |
| Potassium hydroxide | 56 g |
| Benzyl alcohol | 1.5 g |
| Carbon black dispersion (25%) | 600 g |
| Water to make | 1 kg |

0.8 g portions of the processing solution having the above-described composition were retained in "pressure-rupturable containers".

Cover Sheet:

On a transparent film support of polyethylene terephthalate, Layer 1' to Layer 3' described below were coated in this order to prepare a cover sheet.

Layer 1': Neutralizing layer containing a copolymer of acrylic acid and butyl acrylate (weight ratio: 80/20) (22 g/m$^2$) and 1,4-bis(2,3-epoxypropoxy)butane (0.44 g/m$^2$)
Layer 2': Layer containing acetyl cellulose (as modified by hydrolysis of 100 g acetyl cellulose to form 39.4 g of acetyl group (3.8 g/m$^2$), a copolymer of styrene and maleic anhydride (weight ratio: 60/40, molecular weight: about 50,000) (0.2 g/m$^2$) and 5-(8-cyanoethylthio)-1-phenyltetrazole (0.115 g/m$^2$)
Layer 3': Layer containing a copolymer latex of vinylidene chloride, methyl acrylate and acrylic acid (weight ratio: 85/12/3) (2.5 g/m$^2$) and polymethyl methacrylate latex (particle size: 1 to 3 μm) (0.05 g/m$^2$)

Exposure to Light and Development Processing

The above-described cover sheet was superposed on each of the above-described light-sensitive sheets, and image exposure was conducted through a continuous gradation wedge from the cover sheet side. Then, the above-described processing solution was spread in a thickness of 75 μm between these two sheets using pressure-applying rollers. The spread processing was conducted at 22° C. 100 Seconds after the processing, cyan color density of the image transferred on the mordant layer (image-receiving layer) was measured through the transparent support of the light-sensitive sheet by a reflective densitometer. The results thus-obtained are shown in Table 4 below.

TABLE 4

| Sample No. | Nucleating Agent | Nucleating Accelerating Agent | Before Incubation Dmax | Before Incubation Dmin | After Incubation Dmax | After Incubation Dmin | Remarks |
|---|---|---|---|---|---|---|---|
| 1 | N-I-23 | A-7 | 2.30 | 0.33 | 2.25 | 0.33 | Present Invention |
| 2 | " | A-12 | 2.35 | 0.33 | 2.32 | 0.33 | Present Invention |
| 3 | N-I-25 | A-9 | 2.36 | 0.33 | 2.33 | 0.33 | Present Invention |
| 4 | " | A-2 | 2.38 | 0.33 | 2.35 | 0.33 | Present Invention |
| 5 | N-A | A-9 | 2.02 | 0.33 | 1.80 | 0.33 | Comparison |
| 6 | " | A-2 | 1.98 | 0.34 | 1.72 | 0.33 | " |
| 7 | N-I-23 | — | 1.56 | 0.34 | 1.06 | 0.37 | " |
| 8 | N-I-25 | — | 1.48 | 0.34 | 0.95 | 0.37 | " |
| 9 | N-A | — | 1.31 | 0.34 | 0.80 | 0.42 | " |

As is apparent from the results shown in Table 4, Sample Nos. 1 to 4 according to the present invention have high $D_{max}$ in comparison with Comparative Sample Nos. 5 to 9. In addition, the above-described effect is remarkably exhibited even after the incubation test.

While the invention has been described in detail and with reference to specific embodiments thereof, it will be apparent to one skilled in the art that various changes and modifications can be made therein without departing from the spirit and scope thereof.

What is claimed is:

1. A direct positive photographic light-sensitive material comprising a support having thereon at least one internal latent image type silver halide emulsion layer not having been previously fogged, wherein the photographic light-sensitive material contains at least one nucleating agent represented by the formula (N-I) and at least one nucleating accelerating agent selected from compounds represented by the formulae (A-I) and (A-II):

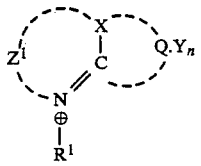

(N-I)

wherein $Z^1$ represents a non-metallic atomic group necessary to form a 5-membered or 6-membered heterocyclic ring to which an aromatic ring or a heterocyclic ring may further be condensed; $R^1$ represents an aliphatic group; X represents $=\underset{|}{C}-$ or $-\underset{|}{N}-$;

Q represents a non-metallic atomic group necessary to form a 4-membered to 12-membered nonaromatic hydrocarbon ring or nonaromatic heterocyclic ring; at least one of $R^1$, a substituent for $Z^1$ and a substituent for Q includes an alkynyl group; Y represents a counter ion necessary for charge balance; and n represents a number necessary to balance a charge (A-I)

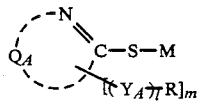

wherein $Q_A$ represents an atomic group necessary to form a 5-membered or 6-membered heterocyclic ring to which a carbocyclic aromatic ring or a heterocyclic aromatic ring may further be condensed; $Y_A$ represents a divalent linkage group comprising an atom or atomic group containing at least one of a hydrogen atom, a carbon atom, a nitrogen atom, an oxygen atom, and a sulfur atom; R represents an organic group containing at least one of a thioether group, an amino group, an ammonium group, an ether group, or a heterocyclic group; l represents 0 or 1; m represents 0, 1 or 2; and M represents a hydrogen atom, an alkali metal atom, an ammonium group or a group capable of being cleaved under an alkaline condition, (A-II)

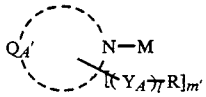

wherein $Q_A'$ represents an atomic group necessary to form a 5-membered or 6-membered heterocyclic ring which is capable of forming imino silver; $Y_A$, R, l and M each has the same meaning as defined in the general formula (A-I) above; and m' represents 1 or 2.

2. A direct positive photographic light-sensitive material as claimed in claim 1, wherein the heterocyclic ring completed with $Z^1$ is a quinolinium nucleus, a benzimidazolium nucleus, a pyridinium nucleus, a thiazolium nucleus, a selenazolium nucleus, an imidazolium nucleus, a tetrazolium nucleus, an indolenium nucleus, a pyrrolinium nucleus, an acridinium nucleus, a phenanthridinium nucleus, an isoquinolium nucleus, or a naphthopyridinium nucleus.

3. A direct positive photographic light-sensitive material as claimed in claim 1, wherein the heterocyclic ring completed with $Z^1$ is substituted with a substituent selected from the group consisting of an alkyl group, an alkenyl group, an aralkyl group, an aryl group, an alkynyl group, a hydroxy group, an alkoxy group, an aryloxy group, a halogen atom, an amino group, an alkylthio group, an arylthio group, an acyloxy group, an acylamino group, a sulfonyl group, a sulfonyloxy group, a-sulfonylamino group, a carboxyl group, an acyl group, a carbamoyl group, a sulfamoyl group, a sulfo group, a cyano group, a ureido group, a urethane group, a carbonic acid ester group, a hydrazine group, a hydrazone group and an imino group.

4. A direct positive photographic light-sensitive material as claimed in claim 1, wherein the aliphatic group represented by $R^1$ is an alkynyl group.

5. A direct positive photographic light-sensitive material as claimed in claim 1, wherein the nonaromatic hydrocarbon ring completed with Q is selected from the group consisting of a cyclopentane ring, a cyclohexane ring a cyclohexene ring, a cycloheptane ring, an indan ring and a tetralin ring.

6. A direct positive photographic light-sensitive material as claimed in claim 1, wherein the nonaromatic heterocyclic ring completed with Q is selected from the group consisting of a tetrahydrofuran ring, a tetrahydropyran ring, a butyrolactone ring, a pyrrolidone ring, a tetrahydrothiophene ring, a pyrrolidine ring, a piperidine ring, a pyridone ring, a piperazine ring, a perhydrothiazine ring, a tetrahydroquinoline ring and an indoline ring.

7. A direct positive photographic light-sensitive material as claimed in claim 1, wherein the alkynyl group which is present in $R^1$, a substituent for $Z^1$ or a substituent for Q is an alkynyl group having from 2 to 18 carbon atoms.

8. A direct positive photographic light-sensitive material as claimed in claim 1, wherein at least one of $R^1$, $Z^1$ and Q include a group capable of accelerating adsorption onto silver halide grains.

9. A direct positive photographic light-sensitive material as claimed in claim 8, wherein the group capable of accelerating adsorption is represented by the following general formula:

$$X^1\text{-}(L^1)_{m''}$$

wherein $X^1$ represents a group capable of accelerating adsorption onto silver halide grains; $L^1$ represents a divalent linking group; and m'' represents 0 or 1.

10. A direct positive photographic light-sensitive material as claimed in claim 9, wherein the group capable of accelerating adsorption is a thioamido group, a mercapto group or a 5-membered or 6-membered nitrogen-containing heterocyclic group.

11. A direct positive photographic light-sensitive material as claimed in claim 10, wherein the 5-membered or 6-membered nitrogen-containing heterocyclic group is one which will form an imino silver.

12. A direct positive photographic light-sensitive material as claimed in claim 8, wherein the group capable of accelerating adsorption is a thioamido group, an azole group or a heterocyclic mercapto group.

13. A direct positive photographic light-sensitive material as claimed in claim 1, wherein the nucleating agent represented by the formula (N-I) is present in a silver halide emulsion layer or a hydrophilic colloid layer adjacent thereto.

14. A direct positive photographic light-sensitive material as claimed in claim 13, wherein the nucleating agent is present in a silver halide emulsion layer.

15. A direct positive photographic light-sensitive material as claimed in claim 1, wherein the heterocyclic ring completed with $Q_A$ is substituted with a substituent selected from the group consisting of a nitro group, a halogen atom, a mercapto group, a cyano group, a substituted or unsubstituted alkyl group, a substituted or unsubstituted aryl group, a substituted or unsubstituted alkenyl group, a substituted or unsubstituted aralkyl group, a sulfonyl group, a carbamoyl group, a sulfamoyl group, a carbonamido group, a sulfonamido group, an acyloxy group, a sulfonyloxy group, a ureido group, a thioureido group, an acyl group, an oxycarbonyl group, and an oxycarbonylamino group.

16. A direct positive photographic light-sensitive material as claimed in claim 1, wherein the heterocyclic ring represented by $Q_A'$ is an indazole, a benzimidazole, a benzotriazole, a benzoxazole, a benzothiazole, an imidoazole, a thiazole, an oxazole, a triazole, a tetrazole, a tetraazaindene, a triazaindene, a diazaindene, a pyrazole or an indole.

17. A direct positive photographic light-sensitive material as claimed in claim 1, wherein the nucleating accelerating agent is selected from the group consisting of compounds represented by the formula (A-III), the formula (A-IV), the formula (A-V), the formula (A-VI) and tetraazaindenes, triazaindenes and pentaazaindenes each having at least one mercapto group

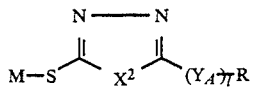
(A-III)

wherein M, R, $Y_A$ and l each has the same meaning as defined in the formula (A-I); and $X^2$ represents an oxygen atom, a sulfur atom or a selenium atom,

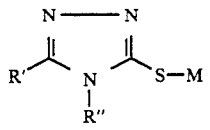
(A-IV)

wherein R' represents a hydrogen atom, a halogen atom, a nitro group, a mercapto group, an unsubstituted amino group, a substituted or unsubstituted alkyl group, a substituted or unsubstituted alkenyl group, a substituted or unsubstituted aralkyl group, a substituted or unsubstituted aryl group or $\text{-}(Y_A)_l\text{-}R$; R' represents a hydrogen atom, an unsubstituted amino group or $\text{-}(Y_A)_l\text{-}R$, when both R' and R'' represent $\text{-}(Y_A)_l\text{-}R$, they may be the same or different, provided that at least one of R' and R'' represents $\text{-}(Y_A)_l\text{-}R$; and M, R, $Y_A$ and l each has the same meaning as defined for the formula (A-I),

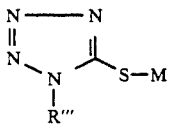
(A-V)

wherein R''' represents $-(Y_A)_l-R$; and M, R, $Y_A$ and 1 each has the same meaning as defined in the formula (A-I),

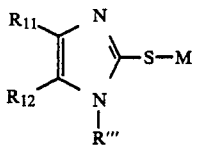

(A-VI)

wherein $R_{11}$ and $R_{12}$, which may be the same or different, each represents a hydrogen atom, a halogen atom, a substituted or unsubstituted amino group, a nitro group, a substituted or unsubstituted alkyl group, a substituted or unsubstituted alkenyl group, a substituted or unsubstituted aralkyl group or a substituted or unsubstituted aryl group; R''' represents $-(Y_A)_l-R$; and M, R, $Y_A$ and 1 each has the same meaning as defined for the formula (A-I).

18. A direct positive photographic light-sensitive material as claimed in claim 1, wherein the nucleating accelerating agent represented by the formula (A-I) or (A-II) is present in a silver halide emulsion layer or a hydrophilic colloid layer adjacent thereto.

19. A direct positive photographic light-sensitive material as claimed in claim 1, wherein the internal latent image type silver halide emulsion layer is a monodispersed silver halide emulsion layer.

* * * * *

UNITED STATES PATENT AND TRADEMARK OFFICE

CERTIFICATE OF CORRECTION

PATENT NO. : 4,966,836

DATED : October 30, 1990

INVENTOR(S) : Noriyuki Inoue et al

It is certified that error appears in the above-identified patent and that said Letters Patent is hereby corrected as shown below:

Column 52, line 55, delete "; R'" and insert therefor --, and R"--;

lines 57-58, delete "when both R' and R" represent $\leftarrow Y_A \rightarrow_\ell R$, they may be the same or different,";

line 59, before "; and M, R," insert --, and when both R' and R" represent $\leftarrow Y_A \rightarrow_\ell R$, they may be the same or different--.

Signed and Sealed this

Sixth Day of October, 1992

*Attest:*

DOUGLAS B. COMER

*Attesting Officer*

*Acting Commissioner of Patents and Trademarks*